US012070099B2

(12) United States Patent
Callahan et al.

(10) Patent No.: US 12,070,099 B2
(45) Date of Patent: Aug. 27, 2024

(54) ARTICLE OF FOOTWEAR HAVING ARTICULATING STROBEL WITH BLADDER AND TENSILE COMPONENT

(71) Applicant: NIKE, Inc., Beaverton, OR (US)

(72) Inventors: Ryan P. Callahan, Portland, OR (US); Jeremy L Connell, Hillsboro, OR (US); Carrie L. Davis, Portland, OR (US); Windra Fahmi, Beaverton, OR (US); Gjermund Haugbro, Beaverton, OR (US); Fiona L. Lesecq, Portland, OR (US); Jason R. Meeker, Hillsboro, OR (US); Benjamin Stewart, Beaverton, OR (US); Dylan S. Van Atta, Portland, OR (US); Darlan Zacharia, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 139 days.

(21) Appl. No.: 17/690,900

(22) Filed: Mar. 9, 2022

(65) Prior Publication Data

US 2022/0322787 A1 Oct. 13, 2022

Related U.S. Application Data

(60) Provisional application No. 63/173,812, filed on Apr. 12, 2021.

(51) Int. Cl.
*A43B 13/20* (2006.01)
*A43B 9/02* (2006.01)
(Continued)

(52) U.S. Cl.
CPC ..... *A43B 13/20* (2013.01); *A43B 9/02* (2013.01); *A43B 13/127* (2013.01); *A43B 13/181* (2013.01); *A43B 13/40* (2013.01)

(58) Field of Classification Search
CPC ..... A43B 13/20; A43B 13/127; A43B 13/40; A43B 13/189; A43B 13/38; A43B 17/006;
(Continued)

(56) References Cited

U.S. PATENT DOCUMENTS 4,183,156 A 1/1980 Rudy
4,219,945 A 9/1980 Rudy
(Continued)

FOREIGN PATENT DOCUMENTS

CN 111989007 A 11/2020
TW 201808140 A 3/2018
(Continued)

*Primary Examiner* — Khoa D Huynh
*Assistant Examiner* — Haley A Smith
(74) *Attorney, Agent, or Firm* — Quinn IP Law

(57) ABSTRACT

An article of footwear includes a strobel, a footwear upper, and a sole plate. The strobel includes a polymeric bladder defining an interior cavity and configured to retain a fluid in the interior cavity. The polymeric bladder has a peripheral flange extending around a perimeter of the interior cavity from a medial side to a lateral side of the polymeric bladder at a front of the polymeric bladder. The footwear upper is secured to the peripheral flange. The sole plate has a heel portion, a midfoot portion, and a forefoot portion, and a rear extent of the strobel is secured to the sole plate or to the footwear upper forward of a rear extent of the sole plate. A method of manufacturing the article of footwear includes securing the peripheral flange to the upper.

15 Claims, 14 Drawing Sheets

(51) Int. Cl.
*A43B 13/12* (2006.01)
*A43B 13/18* (2006.01)
*A43B 13/40* (2006.01)

(58) Field of Classification Search
CPC ..... A43B 17/026; A43B 17/03; A43B 7/143; A43B 7/1445; A43B 7/145; A43B 7/1425; A43B 9/02; A43B 13/181
See application file for complete search history.

(56) References Cited

U.S. PATENT DOCUMENTS

| | | | | |
|---|---|---|---|---|
| 4,936,029 | A | 6/1990 | Rudy | |
| 5,042,176 | A | 8/1991 | Rudy | |
| 5,595,004 | A | 1/1997 | Lyden et al. | |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 8,281,504 | B2 | 10/2012 | Morita et al. | |
| 8,839,530 | B2 * | 9/2014 | Smith | A43B 13/40 36/12 |
| 9,894,959 | B2 | 2/2018 | Taylor et al. | |
| 10,477,919 | B2 | 11/2019 | Taylor et al. | |
| 10,485,298 | B2 | 11/2019 | Greene | |
| 10,709,199 | B2 * | 7/2020 | Conway | B32B 5/026 |
| 11,039,662 | B2 | 6/2021 | Taylor et al. | |
| 11,044,964 | B2 * | 6/2021 | Meeker | A43C 15/161 |
| 2009/0126226 | A1 | 5/2009 | Morita et al. | |
| 2012/0233878 | A1 | 9/2012 | Hazenberg et al. | |
| 2012/0260526 | A1 * | 10/2012 | Smith | A43B 13/20 36/83 |
| 2016/0192737 | A1 | 7/2016 | Campos, II et al. | |
| 2017/0042286 | A1 | 2/2017 | Meschter et al. | |
| 2018/0125162 | A1 | 5/2018 | Taylor et al. | |
| 2018/0255871 | A1 * | 9/2018 | Conway | B32B 7/12 |
| 2018/0332924 | A1 | 11/2018 | Bailey et al. | |
| 2018/0332925 | A1 | 11/2018 | Bailey et al. | |
| 2019/0261739 | A1 | 8/2019 | Taylor et al. | |
| 2019/0365036 | A1 * | 12/2019 | Meeker | A43B 13/12 |
| 2019/0365038 | A1 | 12/2019 | Auyang et al. | |
| 2019/0365039 | A1 * | 12/2019 | Auyang | B29D 35/142 |
| 2019/0365040 | A1 | 12/2019 | Auyang et al. | |
| 2019/0380436 | A1 | 12/2019 | Dojan et al. | |
| 2021/0298419 | A1 | 9/2021 | Aslani et al. | |

FOREIGN PATENT DOCUMENTS

| | | | |
|---|---|---|---|
| TW | M595979 | U | 6/2020 |
| TW | 202023428 | A | 7/2020 |
| TW | 202027639 | A | 8/2020 |

* cited by examiner

ARTICLE OF FOOTWEAR HAVING ARTICULATING STROBEL WITH BLADDER AND TENSILE COMPONENT

CROSS-REFERENCE TO RELATED APPLICATION

This application claims the benefit of priority to U.S. Provisional Application No. 63/173,812, filed Apr. 12, 2021 which is incorporated by reference in its entirety.

TECHNICAL FIELD

The present disclosure generally relates to an article of footwear including a strobel configured as a fluid-filled bladder.

BACKGROUND

Articles of footwear generally include two primary elements: an upper and a sole structure. The sole structure is configured to be located under a wearer's foot to space the foot away from the ground. Mobility, flexibility, support, and cushioning are sometimes competing objectives in designing a sole structure.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
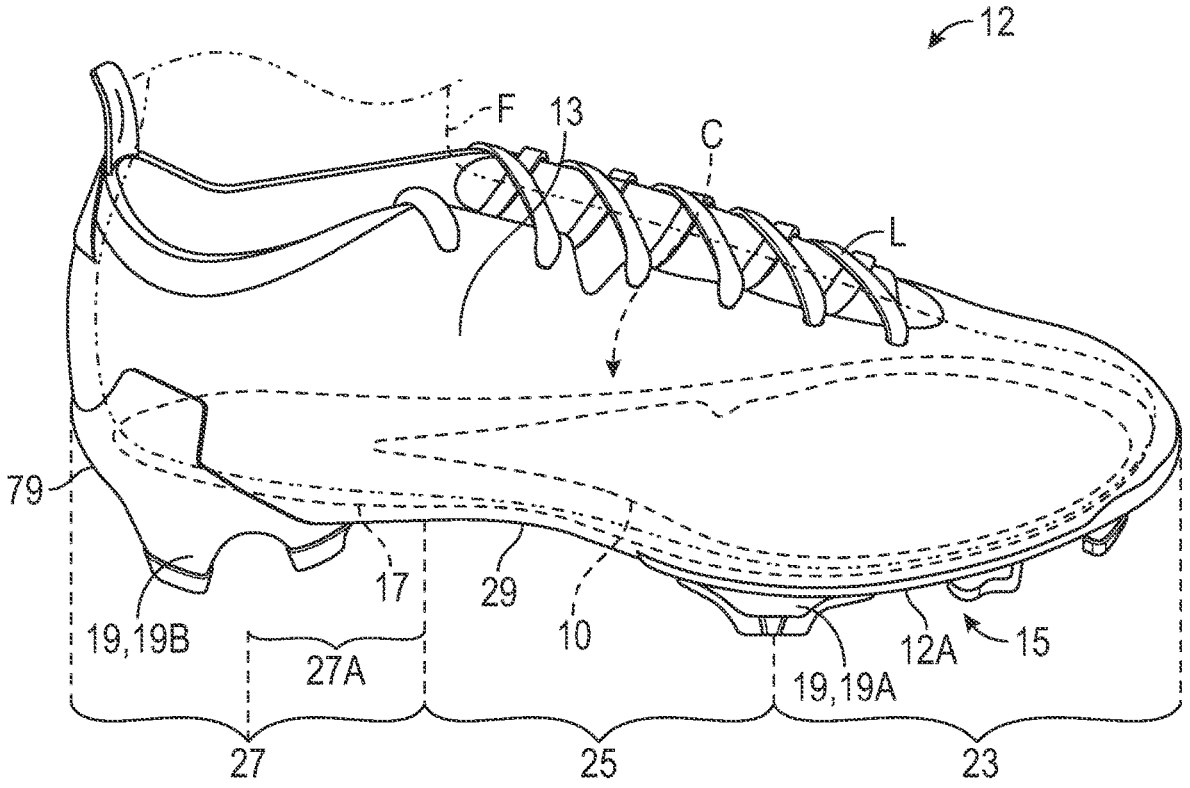
FIG. 1 is a lateral perspective view of an article of footwear.

The present disclosure generally relates to an article of footwear that includes a polymeric bladder serving as a strobel, with the polymeric bladder secured to an upper and a sole plate in order to integrate the cushioning and energy return advantages of a bladder with the stability of the sole plate. Additionally, the configuration of these assembled components achieves a sole structure with a relatively low profile and that flexes and articulates in a desired manner.

More particularly, in an example, the article of footwear includes a strobel, a footwear upper, and a sole plate. The strobel includes a polymeric bladder defining an interior cavity and configured to retain a fluid in the interior cavity. The polymeric bladder has a peripheral flange extending around a perimeter of the interior cavity from a medial side to a lateral side of the polymeric bladder and at a front of the polymeric bladder. The footwear upper is secured to the peripheral flange. The sole plate has a heel portion, a midfoot portion, and a forefoot portion, and a rear extent of the strobel is secured to the sole plate or to the footwear upper forward of a rear extent of the sole plate.

Accordingly, the polymeric bladder underlies the foot in the forefoot region but not in the heel region. Because the strobel is not a full-length strobel, the flexibility of the footwear (e.g., in the longitudinal direction, such as during dorsiflexion) is greater than if the strobel were a full-length strobel). In an implementation, a rear extent of the strobel may be secured to a foot-facing surface of the sole plate rearward of the forefoot portion of the sole plate and forward of the rear extent of the sole plate, which is in the heel portion of the sole plate.

Additionally, the strobel may taper in transverse width so that a midfoot portion of the strobel is narrower than the midfoot portion of the sole plate underlying the midfoot portion of the strobel. This further increases flexibility of the footwear, both in the longitudinal and transverse directions as, generally, a narrower or shorter component will flex or bend more easily than a wider or taller component.

The footwear upper may be constructed to ensure stable securement of the strobel to the upper. In an example, the footwear upper wraps under the sole plate between a medial side of the sole plate and a lateral side of the sole plate and extends transversely outward of the polymeric bladder and the sole plate. In another example, the footwear upper wraps under the bladder where it is disposed between the bladder and the sole plate, and extends transversely outward of the polymeric bladder and the sole plate In some examples, the footwear upper is stitched to the strobel. For example, the article of footwear may include a tensile member defining stitches extending through the footwear upper and the peripheral flange, the stitches securing the footwear upper to the peripheral flange.

In an aspect, the forefoot portion of the sole plate may include a medial arm and a lateral arm spaced apart from the medial arm to define a central gap between the medial and lateral arms in the forefoot portion of the sole plate. The polymeric bladder may span the central gap. Because of the central gap, the sole plate does not underlie that portion of the polymeric bladder that spans the central gap, which helps to decrease the overall height of the sole structure at that portion. The arms, however, still provide lateral and medial stability in the forefoot region, such as may be desirable to support the foot during side (transverse) movements. In an implementation, a rear extent of the polymeric bladder is secured to the heel portion of the sole plate rearward of the central gap. The connection of the bladder rearward of the central gap as well as transversely outward of the central gap (e.g., to the medial and lateral arms) may provide a trampoline-like effect during dynamic compressive loading of the bladder.

The sole plate may have other structural features that provide advantages. For example, the sole plate may include a plurality of upwardly-extending support ribs arranged in a web pattern and defining a plurality of recesses between the support ribs. The ribs stiffen the sole plate while the recesses allow the stiffening to be accomplished without minimal added weight. In another alternative, the sole plate may include a plurality of slats in the heel portion of the sole plate. Like the support ribs, the slats provide stiffening with minimal added material.

In another aspect, the article of footwear may include an outsole underlying the sole plate. In some examples, the footwear upper may be sandwiched between the outsole and the sole plate. This further helps to secure the upper relative to the sole structure, which may include the bladder, the sole plate, and the outsole.

In some implementations, the outsole may include a forefoot outsole underlying the forefoot portion of the sole plate and a heel outsole underlying the heel portion of the sole plate and decoupled from the forefoot outsole. The decoupled forefoot and heel outsole further enhance flexibility of the footwear.

In an example in which the forefoot portion of the sole plate includes a medial arm and a lateral arm spaced apart from the medial arm to define a central gap in the forefoot portion of the sole plate with the polymeric bladder spanning the central gap, the forefoot outsole may have a peripheral rim defining a forefoot aperture underlying the central gap of the sole plate. Stated differently, the forefoot aperture of the forefoot outsole further complements the central gap in the forefoot portion of the sole plate and its ability to allow a trampoline effect of the bladder at the central gap.

In an implementation, the forefoot outsole may include at least one transverse arm extending transversely inward from the peripheral rim into the forefoot aperture of the forefoot outsole and under the central gap of the sole plate. The transverse arm provides targeted support under the bladder to the overlying foot. For example, the at least one transverse arm may include a medial transverse arm extending transversely inward from a medial side of the forefoot outsole and terminating in the forefoot aperture, and a lateral transverse arm extending transversely inward from a lateral side of the forefoot outsole and terminating in the forefoot aperture, and the lateral transverse arm rearward of the medial transverse arm. These may be configured, for example, to align with toes of the overlying foot to assist in providing a stable platform for toe off, while leaving the area of the central gap aligned with metatarsal heads of the foot unobstructed by any underlying portion of the forefoot outsole for a cushioned feel under the metatarsal heads.

In another aspect, the forefoot outsole may include a transverse bar spanning from a medial side of the peripheral rim of the forefoot outsole to a lateral side of the peripheral rim of the forefoot outsole rearward of the at least one transverse arm. The transverse bar may be configured to be disposed rearward of the metatarsal heads of the overlying foot.

In an example of an article of footwear having the decoupled forefoot outsole and heel outsole discussed above, the heel outsole may include a central vertical through hole. This minimizes weight and may transfer impact loads to the sole plate around but not directly under a center of the heel of the overlying foot.

In another example, the forefoot portion of the sole plate may include a medial arm and a lateral arm spaced apart from the medial arm to define a central gap in the forefoot portion of the sole plate with the polymeric bladder spanning the central gap, and the sole plate may include at least one transverse arm extending transversely inward into the central gap of the sole plate. Similar to the example where a forefoot outsole includes such a transverse arm, the transverse arm provides targeted support under the bladder to the overlying foot. In an implementation, the at least one transverse arm may include a medial transverse arm extending transversely inward from a medial side of the sole plate and terminating in the central gap, and a lateral transverse arm rearward of the medial transverse arm and extending transversely inward from a lateral side of the sole plate and terminating in the central gap. In a further example, the sole plate includes at least two medial transverse arms and at least two lateral transverse arms.

A method of manufacturing an article of footwear includes disposing a strobel on a foot-facing surface of a sole plate or on an inner surface of a footwear upper. The strobel includes a polymeric bladder defining an interior cavity and configured to retain a fluid in the interior cavity. The polymeric bladder has a peripheral flange extending around a perimeter of the interior cavity from a medial side to a lateral side of the polymeric bladder at a front of the polymeric bladder. The sole plate has a heel portion, a midfoot portion, and a forefoot portion. The method includes securing a rear extent of the strobel to the sole plate or to the footwear upper forward of a rear extent of the sole plate, and further includes securing the footwear upper to the peripheral flange. In an example, securing the footwear upper to the peripheral flange may include stitching a tensile member through the footwear upper and the peripheral flange.

Prior to securing the footwear upper to the peripheral flange, the method may include wrapping the footwear upper under the sole plate between a medial side of the sole plate and a lateral side of the sole plate so that the footwear upper extends transversely outward of the polymeric bladder and the sole plate. Under the method, an outsole may be secured to the footwear upper under the sole plate, such as to an outer surface of the footwear upper.

In another example, prior to securing the footwear upper to the peripheral flange, the method may include wrapping the footwear upper under the strobel between a medial side of the sole plate and a lateral side of the sole plate so that the footwear upper extends between the polymeric bladder and the foot-facing surface of the sole plate and extends transversely outward of the polymeric bladder. Under the method, an outsole may be secured to the sole plate, such as to a ground-facing surface of the sole plate opposite from the foot-facing surface.

The above features and advantages and other features and advantages of the present teachings are readily apparent from the following detailed description of the modes for carrying out the present teachings when taken in connection with the accompanying drawings. It should be understood that, even though in the following drawings, embodiments may be separately described, single features thereof may be combined to additional embodiments.

Referring to the drawings, wherein like reference numbers refer to like components throughout the views, FIG. 1 shows a strobel 10 and an article of footwear 12 that includes that strobel 10. The strobel 10 is configured as a fluid-filled bladder 14 disposed in a foot-receiving cavity C to support a foot F (shown in phantom), as further described herein. The strobel 10 is shown and described in more detail in FIGS. 3-8. The foot F may be directly supported on and in contact with the strobel 10, or a cover (not shown) may be secured over the strobel 10 between the strobel 10 and the foot F.

Figure 2:
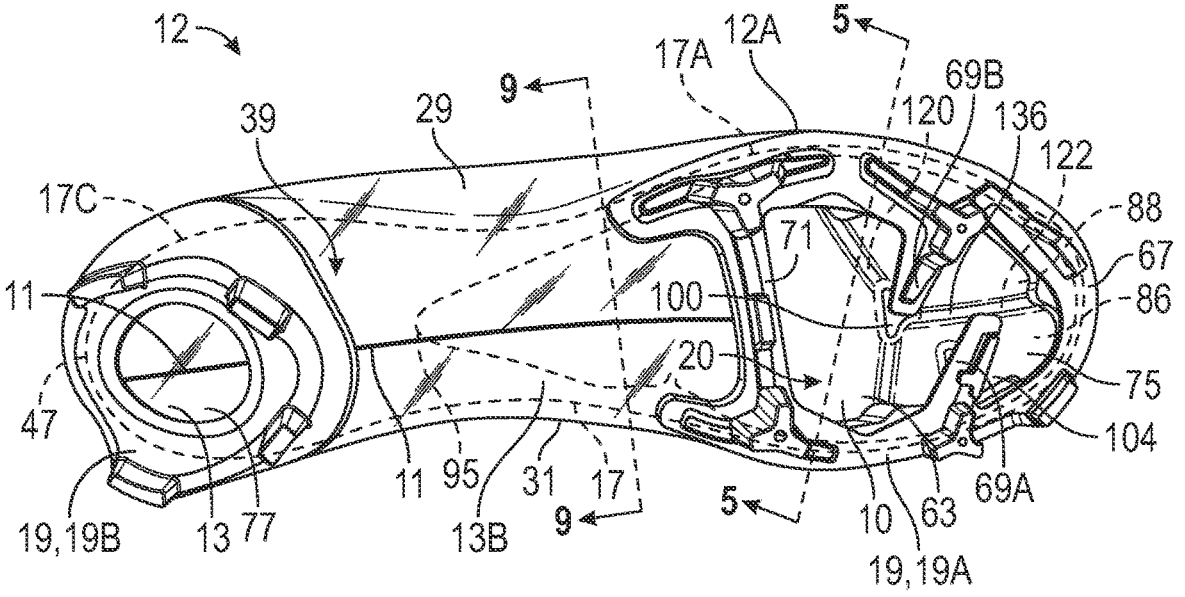
FIG. 2 is a bottom perspective view of the article of footwear of FIG. 1.

The article of footwear 12 includes a footwear upper 13, and a sole structure 15 secured to the footwear upper 13 as described herein. FIG. 1 partially shows the strobel 10 in hidden lines within the foot-receiving cavity C and relative to an outer periphery 12A of the article of footwear 12. The upper 13 and the sole structure 15 define (e.g., physically form) the foot-receiving cavity C and a foot F is shown in phantom resting on the strobel 10 in the foot-receiving cavity C. In addition to the strobel 10, the sole structure 15 includes a sole plate 17 (best shown in FIG. 10) to which the strobel 10 is secured, as well as an outsole 19 that underlies the sole plate 17. In the example of FIG. 1, the sole plate 17 and the strobel 10 are both within the foot-receiving cavity C defined by the upper 13, and the upper 13 wraps under the sole plate 17, as indicated in FIG. 2, where a seam 11 of the upper 13 is shown. In another example, the upper 13 could be seamless. The upper 13 is shown with a lace L, but may have another type of fastener or no fastener, such as a laceless upper.

The footwear 12 has a forefoot region 23, a midfoot region 25, and a heel region 27, which are also the forefoot region, the midfoot region, and the heel region, respectively, of the footwear upper 13 and the sole structure 15 and its components (including the strobel 10, the sole plate 17, and the outsole 19 described herein). The footwear 12 also includes a lateral side 29 and a medial side 31 (best shown in FIG. 2) opposite to the lateral side 29. The lateral side 29 and the medial side 31 are also the lateral side 29 and the medial side 31 of the upper 13 and the sole structure 15 and the components thereof.

The forefoot region 23 generally includes portions of the article of footwear 12 corresponding with the toes and the joints of the foot F connecting the metatarsals with the phalanges (e.g., the metatarsophalangeal joints). The midfoot region 25 generally includes portions of the article of footwear 12 corresponding with the arch area of the foot F, and the heel region 27 corresponds with rear portions of the foot F, including the calcaneus bone. The lateral side 29 and the medial side 31 extend through each of forefoot region 23, the midfoot region 25, and the heel region 27 and correspond with opposite sides of the article of footwear 12. The forefoot region 23, the midfoot region 25, the heel region 27, the lateral side 29 and the medial side 31 are not intended to demarcate precise areas of footwear 12, but are instead intended to represent general areas of footwear 12 to aid in the following discussion.

A peripheral flange 26 of the bladder 14 is relatively wide in the forefoot region 23 in comparison to the heel region 27. A lower edge 13A of the upper 13 (see FIG. 5) forms an aperture 33 so that the bladder 14 is exposed in the forefoot region 23 from below, as shown in FIG. 2. An additional cover layer (not shown) such as a transparent polymeric layer may underlie the bladder 14 at the aperture 33. The peripheral flange 26 has a groove 140 as discussed with respect to FIG. 3. The lower edge 13A of the upper 13 is secured to the peripheral flange 26 of the bladder 14 such as with a tensile member 35 defining stitches. The tensile member 35 may be a thread, yarn, cable, or other elongated member. For example, in FIG. 5, stitches of the tensile member 35 are shown extending through the upper 13 and through the peripheral flange 26 at the groove 140. The forefoot outsole 19A is shown with an upper portion 19C that extends transversely outward of and upward along the upper 13 to cup the upper 13 at the medial and lateral sides in FIG. 5.

Figure 9:
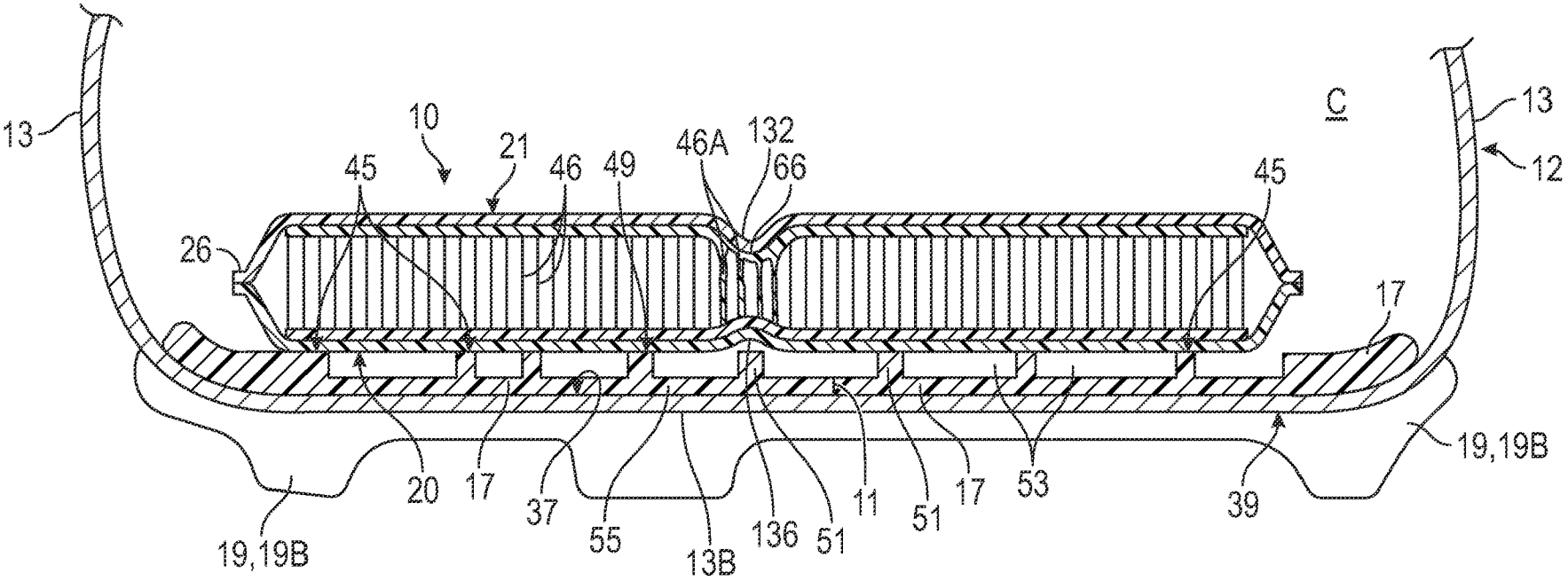
FIG. 9 is a cross-sectional view of the article of footwear of FIGS. 1-2 taken at lines 9-9 in FIG. 2.

A lower portion 13B of the footwear upper 13 is sandwiched between the outsole 19 and the sole plate 17 as best shown in FIGS. 2 and 9. Stated differently, as shown in FIG. 9, the sole plate 17 is disposed on and adhered to an inner surface 37 of the upper 13 such as with adhesive or by thermal bonding, and the outsole 19 is disposed on and adhered to an outer surface 39 of the upper 13 such as with adhesive or by thermal bonding. The footwear upper 13 is thus wrapped under the sole plate 17 between the medial side 31 of the sole plate 17 and the lateral side 29 of the sole plate 17 so that the footwear upper 13 extends transversely outward of the polymeric bladder 14 and the sole plate 17. In addition to the stitches of tensile member 35, this further helps to secure the upper 13 relative to the components of the sole structure 15. The ground-facing surface 20 of the bladder 14 may be secured to a foot-facing surface 45 of the sole plate 17 such as with adhesive or by thermal bonding. The cross-section of FIG. 9 shows the peripheral flange 26 rearward of the locations 151, 153 where the wider portion of the peripheral flange 26 ends. This rearward portion of the peripheral flange is not stitched to the upper 13. Additionally, the bladder 14 narrows significantly compared to the width of the sole plate 17 rearward of locations 151, 153. The heel outsole 19B is rearward of the cross-section of FIG. 9, which is taken with a vantage toward the heel outsole 19B.

Figure 10:
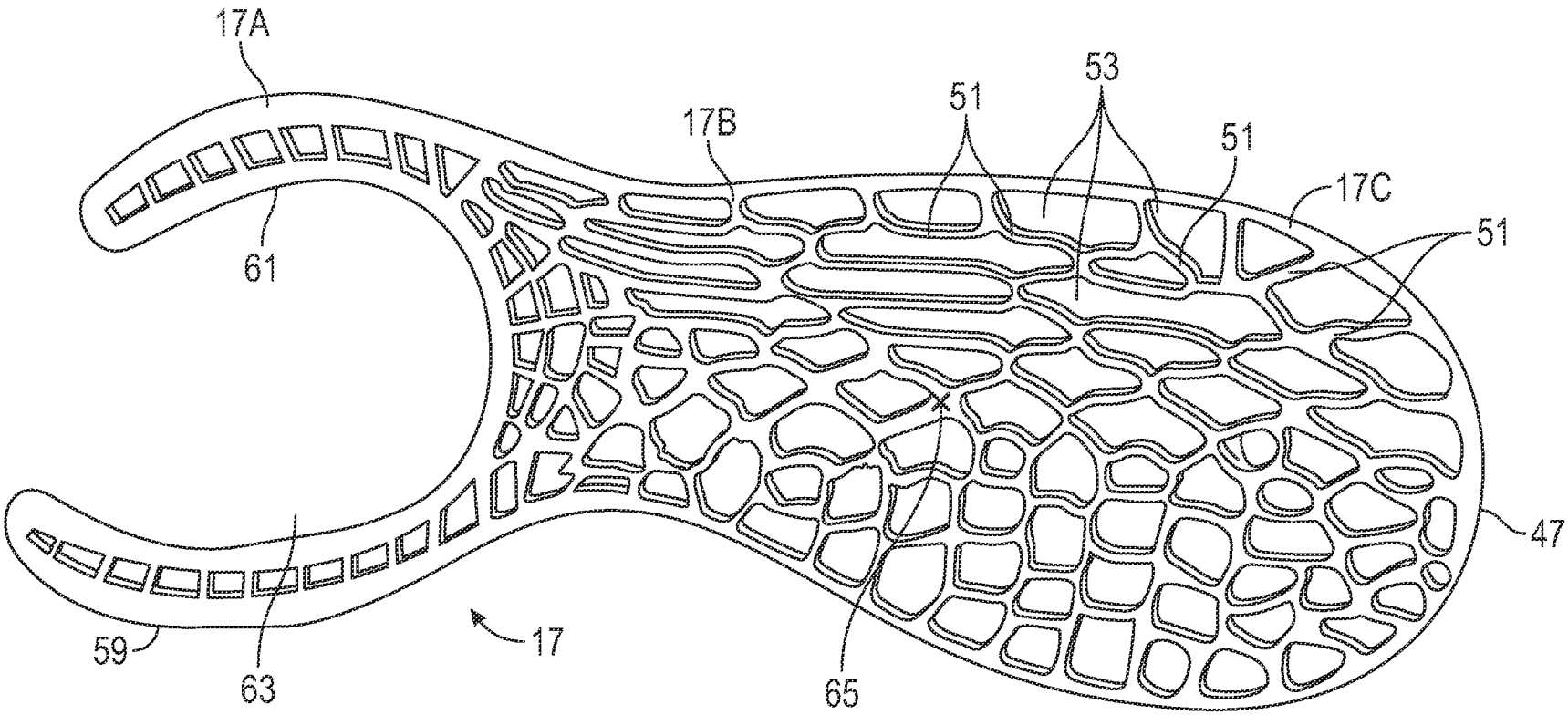
FIG. 10 is a plan view of a foot-facing side of a sole plate included in the article of footwear of FIG. 1.

Referring again to FIGS. 1 and 2, in the example shown, the outsole 19 includes a forefoot outsole 19A underlying a forefoot portion 17A of the sole plate 17 and a heel outsole 19B underlying a heel portion 17C of the sole plate 17. As shown in FIG. 10, the sole plate 17 has the forefoot portion 17A, a midfoot portion 17B, and the heel portion 17C, the portions 17A, 17B, and 17C corresponding with the forefoot region 23, the midfoot region 25, and the heel region 27 of the article of footwear 12. The heel outsole 19B is decoupled from the forefoot outsole 19A. Decoupling the forefoot and heel outsoles 19A, 19B from one another enhances flexibility of the footwear 12 because, as there is no outsole under the midfoot portion 17B of the sole plate 17 between the forefoot and heel outsoles 19A, 19B (e.g., in the midfoot region 25), the sole structure 15 may be thinner in the midfoot region 25 between the forefoot and heel outsoles 19A, 19B, which reduces resistance to lateral and longitudinal flexing.

Additionally, the polymeric bladder 14 is not a full length bladder in that the bladder 14 underlies the foot F in the forefoot region 23 but not in the heel region 27. In the example shown in FIG. 2, a rear extent 95 of the bladder 14 and of the strobel 10 (e.g., a rear extent of the peripheral flange 26) is secured to the foot-facing surface 45 of the sole plate 17 rearward of the forefoot portion 17A of the sole plate 17 and forward of a rear extent 47 of the sole plate 17, which is in the heel portion 17C of the sole plate 17. Because the strobel 10 is not a full-length strobel, the sole structure 15 is thus thinner in the vertical direction and the flexibility of the footwear 12 (e.g., in the longitudinal direction, such as during dorsiflexion) is greater than if the strobel were a full-length strobel).

Additionally, the strobel 10 tapers in transverse width so that a midfoot portion of the strobel 10 (e.g., a portion rearward of locations 151, 153 in FIG. 3, which are the rear extents of the relatively wide portion of the peripheral flange 26) is narrower than the midfoot portion 17B of the underlying sole plate 17. This further increases flexibility of the article of footwear 12, both in the longitudinal and in the transverse direction as, generally, a narrower or shorter component will flex or bend more easily than a wider or taller component.

Figure 3:
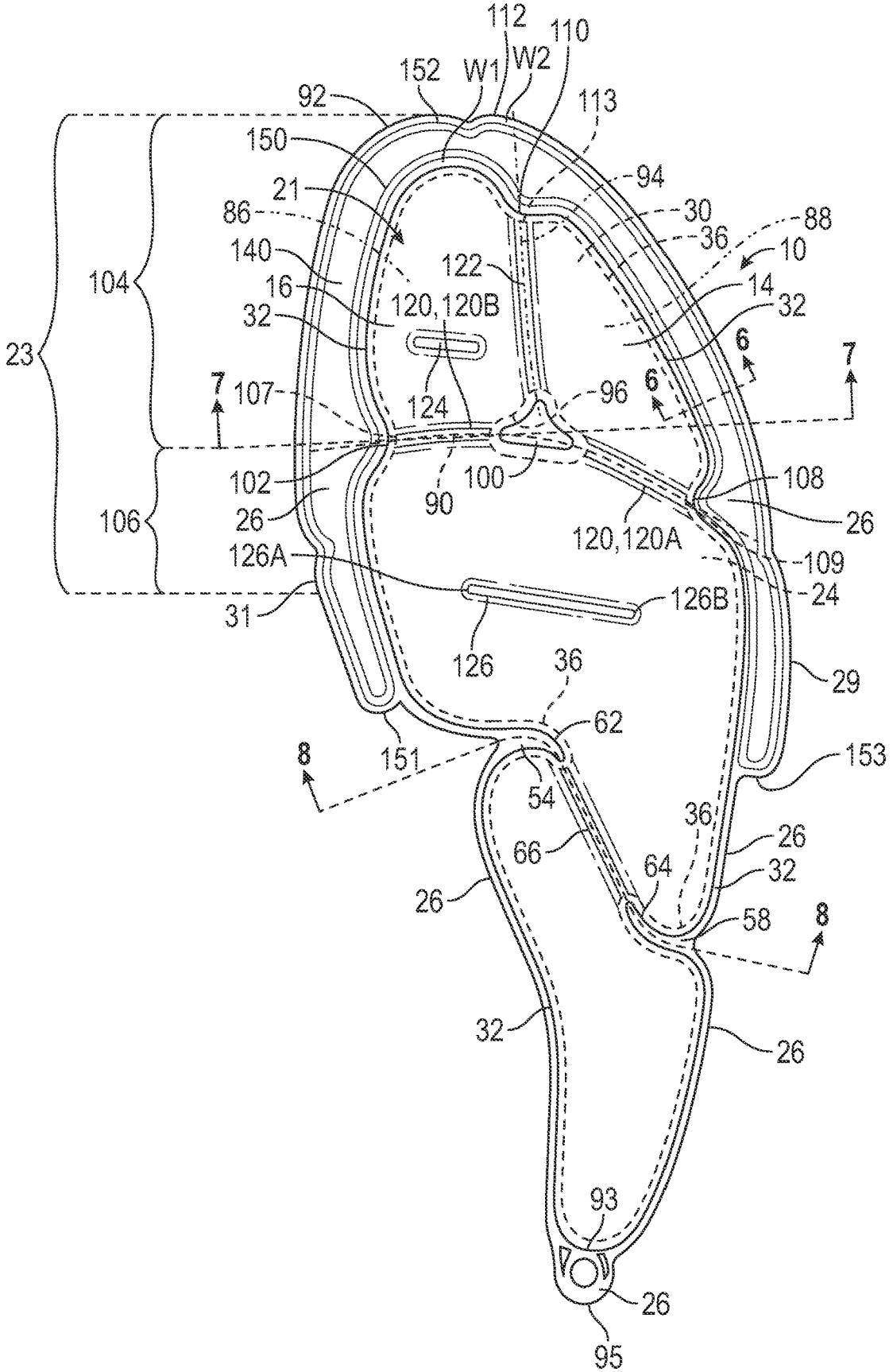
FIG. 3 is a plan view of a top side of a strobel for the article of footwear of FIG. 1.

FIG. 3 is a plan view of the strobel 10 for the article of footwear 12. The strobel 10 is configured as an articulating, fluid-filled polymeric bladder 14. In FIG. 3, a top side (e.g., a first side) of the strobel 10 is shown. The top side is a first polymeric sheet 16 of the bladder 14, also referred to herein as a top sheet. The top side is an exterior surface 21 of the first polymeric sheet 16, which is the foot-receiving surface 21 of the bladder 14 and may be the foot-receiving surface of the sole structure 15 of the article of footwear 12 of FIG. 1. The foot-receiving surface 21 may also be referred to as a foot-facing surface. Optionally, there may be no other layer, cover, or other component of the article of footwear 12 between the bladder 14 and the wearer. Alternatively, a cover layer (not shown) may overlie the bladder 14. Especially in examples without additional foam layers overlying or underlying the bladder 14, the overall height of the sole structure 15 is relatively low, which may be beneficial for some activities. For example, activities that involve extensive lateral movement and/or for which greater tactile feedback is advantageous may benefit from the use of the strobel 10 disclosed herein.

Figure 4:
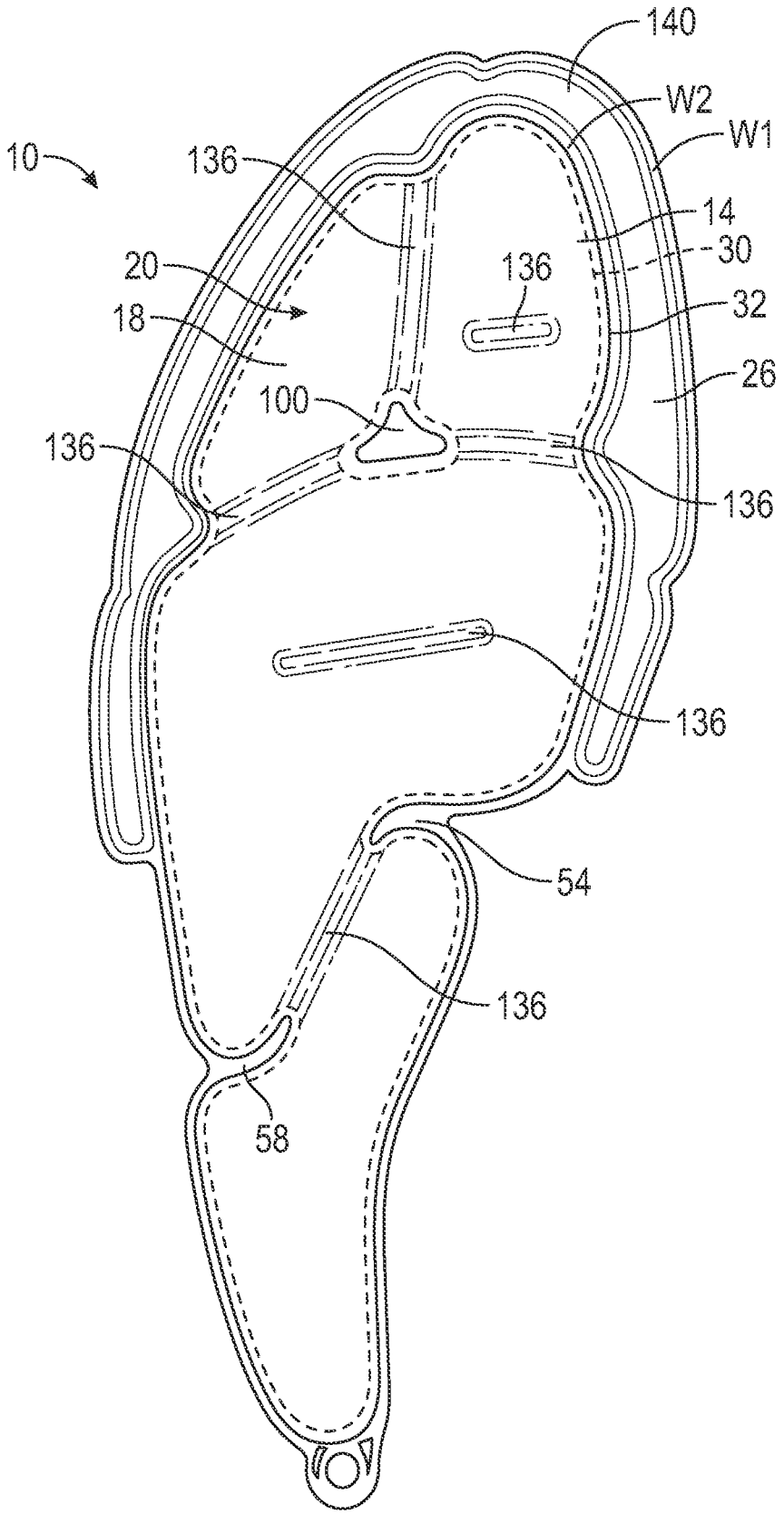
FIG. 4 is a plan view of a bottom side of the strobel of FIG. 3.

FIG. 4 is a plan view of a bottom side (e.g., a second side) of the strobel 10 of FIG. 3. The bottom side is a second polymeric sheet 18 of the bladder 14, also referred to herein as a bottom sheet. The bottom side is the exterior surface 20 of the second polymeric sheet 18, which is the ground-facing surface 20 of the strobel 10 when disposed in the article of footwear 12.

The polymeric bladder 14 defines an interior cavity 24 (best shown in FIGS. 5, 7, and 8) and configured to retain a fluid in the interior cavity 24. More specifically, the first polymeric sheet 16 is secured to the second polymeric sheet 18 at the peripheral flange 26 to enclose the interior cavity 24. Stated differently, when the polymeric sheets 16, 18 are secured together at the peripheral flange 26 and the polymeric bladder 14 is sealed, the first polymeric sheet 16 and the second polymeric sheet 18 retain a fluid in the interior cavity 24. As used herein, a "fluid" filling the interior cavity 24 may be a gas, such as air, nitrogen, another gas, or a combination thereof.

The first and second polymeric sheets 16, 18 can be a variety of polymeric materials that can resiliently retain a fluid such as nitrogen, air, or another gas. Examples of polymeric materials for the first and second polymeric sheets 16, 18 include thermoplastic urethane, polyurethane, polyester, polyester polyurethane, and polyether polyurethane. Moreover, the first and second polymeric sheets 16, 18 can each be formed of layers of different materials including polymeric materials. In one example, each of the first and second polymeric sheets 16, 18 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the first and second polymeric sheets 16, 18 are disclosed in U.S. Pat. Nos. 4,183,156 and 4,219,945 to Rudy which are incorporated by reference in their entireties. Further suitable materials for the first and second polymeric sheets 16, 18 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder 14, engineering properties such as tensile strength, stretch properties, fatigue characteristics, dynamic modulus, and loss tangent can be considered. For example, the thicknesses of the first and second polymeric sheets 16, 18 used to form the bladder 14 can be selected to provide these characteristics.

The strobel 10 includes a tensile component 30 disposed in the interior cavity 24. The outer extent of the tensile component 30 is shown in hidden lines within the interior cavity 24 in FIGS. 3-4. As is apparent, the tensile component 30 substantially follows the irregular border of the interior cavity 24 which begins just inward of and tracks the irregular shape of the inner extent 32 of the peripheral flange 26 around the outer periphery 34 of the interior cavity 24 and the outer edge 36 of the tensile component 30. In the example shown, the peripheral flange 26 extends generally in an X-Y plane of the bladder 14, where the Z plane is the plane along the height of the bladder 14 from a proximal surface (foot-receiving surface 21) to the distal surface (ground-facing surface 20, indicated in FIG. 5). The peripheral flange 26 extends around the entire bladder 14, and is wider toward the front of the bladder 14, as discussed herein.

Figure 5:
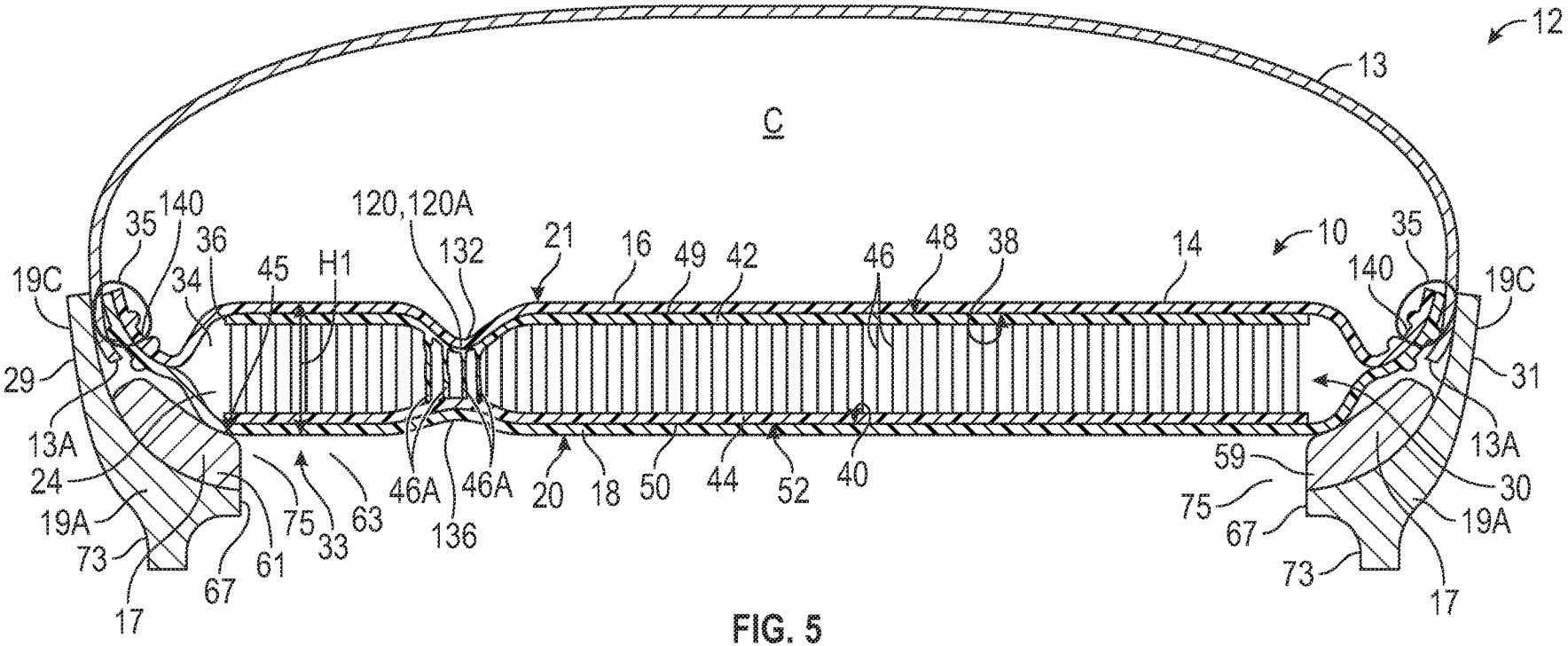
FIG. 5 is a cross-sectional view of the article of footwear of FIGS. 1-2 taken at lines 5-5 in FIG. 2.

As best shown in FIG. 5, the tensile component 30 is secured to opposing inner surfaces 38, 40 of the polymeric bladder 14. The tensile component 30 includes a first tensile layer 42, a second tensile layer 44, and a plurality of tethers 46 spanning the interior cavity 24 from the first tensile layer 42 to the second tensile layer 44. The tethers 46 connect the first tensile layer 42 to the second tensile layer 44. Only some of the tethers 46 are indicated with reference numbers in FIG. 5. The tethers 46 may also be referred to as fabric tensile members or threads and may be in the form of drop threads that connect the first tensile layer 42 and the second tensile layer 44. The tensile component 30 may be formed as a unitary, one-piece textile element having a spacer-knit textile.

The first tensile layer 42 is bonded to the inner surface 38 of the first polymeric sheet 16, and the second tensile layer 44 is bonded to the inner surface 40 of the second polymeric sheet 18. More specifically, a first surface bond 49 joins the inner surface 38 of the first polymeric sheet 16 to the outer surface 48 of the first tensile layer 42. A second surface bond 50 joins the inner surface 40 of the second polymeric sheet 18 to the outer surface 52 of the second tensile layer 44, opposite the first tensile layer 42. Entire interfacing portions of the surfaces 38, 48 are bonded to one another, and entire interfacing portions of the surfaces 40, 52 are bonded to one another.

Figure 7:
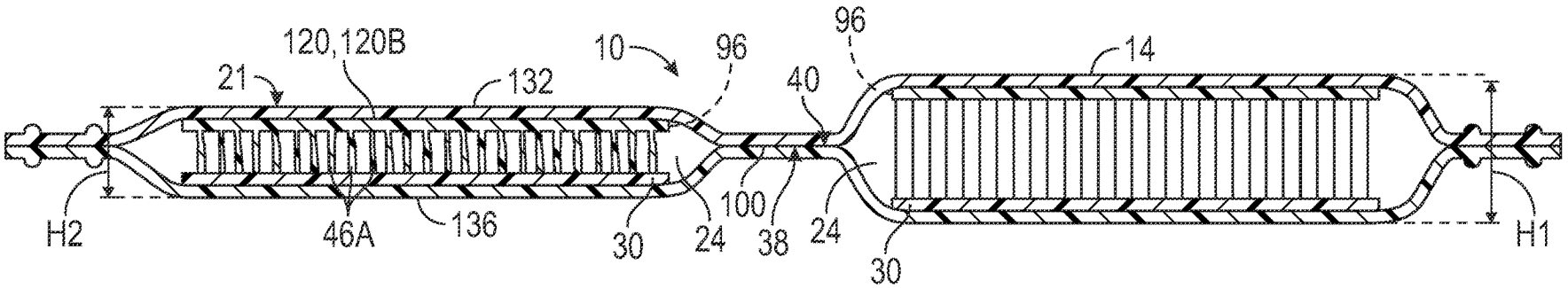
FIG. 7 is a cross-sectional view of the strobel of FIG. 3 taken at lines 7-7 in FIG. 3.

The tethers 46 restrain separation of the first and second polymeric sheets 16, 18 to the maximum separated positions shown in FIG. 5, which depicts the strobel 10 with the interior cavity 24 of the bladder 14 inflated and sealed under a given inflation pressure of gas in the interior cavity 24, so that the strobel 10 is in an inflated state. The outward force on the first and second polymeric sheets 16, 18 due to the pressurized gas in the interior cavity 24 places the tethers 46 in tension, and the tethers 46 prevent the tensile layers 42, 44 and polymeric sheets 16, 18 from further outward movement away from one another. By securing the opposing inner surfaces 38, 40 to one another, the tensile component 30 limits the separation between the opposing inner surfaces 38, 40 due to inflation of the bladder 14. Stated differently, the tensile component 30 limits the height of the inflated bladder 14 to a maximum height H1 from the foot-receiving surface 21 to the ground-facing surface 20 as shown in FIGS. 5 and 7. The maximum height H1 is less than or equal to 5 millimeters. In another example, the maximum height may be less than or equal to 5.5 millimeters, or may be between about 4.5 and 5.5 millimeters. A relatively low height, such as H1, may provide sufficient cushioning and energy return than a higher height without compromising the tactile feedback of the bladder underfoot. Generally, assuming equal pressures in the interior cavity 24, a bladder 14 of greater height will provide less tactile feedback. In an example, the article of footwear 12 may be especially configured as global football (e.g., soccer) footwear to provide cushioning and energy return while still allowing sufficient tactile feedback.

While the tethers 46 limit expansion of the bladder 14 as described, the tethers 46 do not present resistance to compression when the bladder 14 is under a compressive load. When pressure is exerted on the strobel 10 such as due to compressive forces of a dynamic load of a wearer when the article of footwear 12 impacts the ground during running or other movements, the strobel 10 is compressed, and the polymeric sheets 16, 18 move closer together as the tethers 46 collapse (e.g., go slack) in proportion to the load on the first and second polymeric sheets 16, 18 adjacent to the particular tethers 46.

Prior to bonding the tensile component 30 to the first and second polymeric sheets 16, 18, the tethers 46 of the tensile component 30 may all be initial lengths, and in some examples all substantially the same length, and the first and second tensile layers 42, 44 connected by the tethers 46 may have generally flat outer surfaces 48, 52, respectively, directly above the tethers 46.

Figure 8:
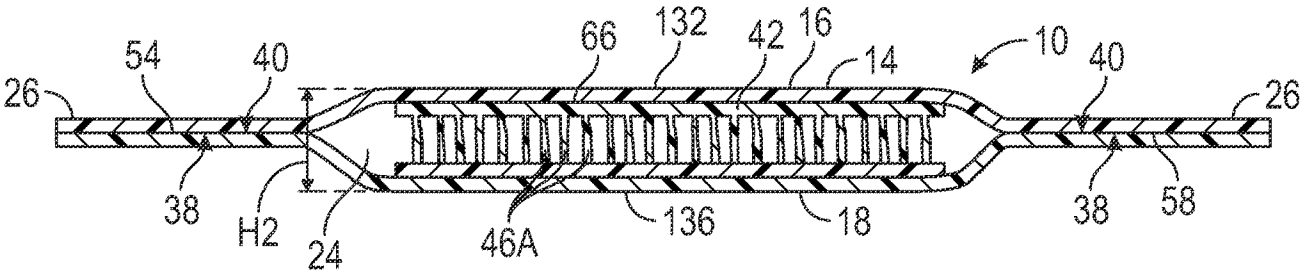
FIG. 8 is a cross-sectional view of the strobel of FIG. 3 taken at lines 8-8 in FIG. 3.

Referring to FIGS. 3 and 8, a first bond 54 secures the opposing inner surfaces 38, 40 of the sheets 16, 18 of the polymeric bladder 14 to one another and extends transversely inward from a medial side 31 of the peripheral flange 26 only partway transversely across the interior cavity 24. A second bond 58 is rearward of the first bond 54, and secures the opposing inner surfaces 38, 40 of the polymeric bladder 14 to one another. The second bond 58 extends transversely inward from a lateral side 29 of the peripheral flange 26 only partway transversely across the interior cavity 24. The outer edge 36 of the tensile component 30 extends transversely inward at and borders a perimeter 62 of the first bond 54 and a perimeter 64 of the second bond 58. Because the tensile component 30 borders and does not extend between the inner surfaces 38, 40 at the first bond 54 and the second bond 58, the bladder 14 is of a lesser height at the first bond 54 and the second bond 58 than at the tensile component 30, creating greater flexibility of the bladder 14 at the first and second bonds 54, 58 than at the tensile component 30. Accordingly, articulation of the bladder 14 tends to occur at the first bond 54 and the second bond 58 under longitudinal or lateral flexing of a foot F supported on the bladder 14.

As shown, the first bond 54 and the second bond 58 are both nonlinear. The first bond 54 curves rearward from the medial side 31 of the peripheral flange 26. The second bond 58 curves forward from the lateral side 29 of the peripheral flange 26. By each curving in a direction toward the other, the flexibility of the bladder 14 along a line that connects the two bonds 54, 58 is enhanced. Because the first bond 54 and the second bond 58 extend from opposite sides of the peripheral flange 26 (the medial side 31 and the lateral side 29, respectively), with the second bond 58 rearward of the first bond 54, flexing may tend to occur not only at either or both of the two bonds 54, 58, but along a line between the two bonds 54, 58 which is at an angle to a longitudinal midline of the bladder 14 and extends forward and toward the medial side 31. As further discussed herein, a first partial bond 66 extends along such a line. The first partial bond 66 further increases the flexibility of the bladder 14 as discussed herein.

Referring to FIG. 3, the forefoot region 23 of the strobel 10 includes a hallux portion 86 and a second toe portion 88. The hallux portion 86 extends forward from a metatarsophalangeal joint line 90 to an outer periphery 92 of the flange 26, and from the medial side 31 of the flange 26 to a boundary 94 between the hallux portion 86 and the second toe portion 88. The positions of the metatarsophalangeal joint line 90, the hallux portion 86, and the second toe portion 88 may be based on population averages of the corresponding portions of feet of a size corresponding with the size of the article of footwear 12 in which the strobel 10 is disposed.

The tensile component 30 may have an aperture 96 in the forefoot region 23 of the strobel 10. In FIG. 3, the aperture 96 is shown disposed between the hallux portion 86 and the second toe portion 88 and along the metatarsophalangeal joint line 90. As best shown in FIG. 7, the opposing inner surfaces 38, 40 of the first and second polymeric sheets 16, 18 of the bladder 14 are bonded to one another at the aperture 96 at a central bond 100. The fluid-filled interior cavity 24 and the tensile component 30 surround the central bond 100 at the aperture 96. The bladder 14 is only the height of the two polymeric sheets 16, 18 stacked together at the central bond 100, which is less than the height of the surrounding interior cavity 24. There is therefore less resistance to flexing of the bladder 14 at the aperture 96 than at the fluid-filled interior cavity 24, which, due to inflation pressure (if inflated above ambient pressure) and the presence of the tensile component 30, provides greater resistance to flexing and bending than does the central bond 100. An area between the hallux and the second toe is a natural flex area for a foot F such as when making a lateral move (a move at least partially in a transverse direction), the central bond 100 enhances the flexibility of the strobel 10. Additionally, because the foot F naturally flexes along the metatarsophalangeal joint line 90, if the central bond 100 also falls along the metatarsophalangeal joint line 90, the central bond 100 further increases flexibility of the strobel 10 when disposed in this location.

As is evident in FIGS. 1, 3, and 4, the polymeric bladder 14 extends in the forefoot region 23 and the midfoot region 25 of the footwear 12 and tapers in width (in the transverse direction) in the midfoot region 25 in a rearward direction (e.g., in a direction from the forefoot region 23 toward the heel region 27 of the footwear 12) to a rear extent 93 of the fluid-filled interior cavity 24 that is disposed no further back than a forward half 27A of the heel region 27. In other examples, the rear extent 93 may be in the midfoot region 25. A rear extent 95 of the peripheral flange 26 is also in the forward half 27A (see FIG. 1) of the heel region 27. By limiting the components of the strobel 10 largely to the forefoot and midfoot regions 23, 25 and only a forward half 27A of the heel region 27 (if the bladder 14 extends at all into the heel region 27), the bladder 14 is easier to flex in the longitudinal direction with dorsiflexion of the foot F. Because the bladder 14 tapers in width as it extends rearward (e.g., the portion of the bladder 14 in the midfoot region 25 is narrower than the portion of the bladder 14 in the forefoot region 23) the cushioning and energy return properties of the bladder 14 are focused in the forefoot region 23 and overall bulk of the strobel 10 is minimized.

Referring again to FIG. 3, in addition to the first bond 54, the second bond 58, and a central bond 100 at the aperture 96 in the tensile component 30, the peripheral flange 26 of the bladder 14 may have inward protrusions 102, 108, and 110 at corresponding notches 107, 109, and 113 in the tensile component 30 to promote flexibility of the bladder 14 at those locations. For example, the peripheral flange 26 may have a medial protrusion 102 protruding transversely inward at the medial side 31 of the peripheral flange 26 to define a boundary between a toe section 104 of the forefoot region 23 of the strobel 10 and a metatarsal section 106 of the forefoot region 23. The boundary between the toe section 104 and the metatarsal section 106 is also defined by the metatarsophalangeal joint line 90 as the medial protrusion 102 falls along the metatarsophalangeal joint line 90. Accordingly, the toe section 104 of the forefoot region 23 is forward of the metatarsophalangeal joint line 90 and the medial protrusion 102, and the metatarsal section 106 is rearward of the metatarsophalangeal joint line 90 and the medial protrusion 102. The outer edge 36 of the tensile component 30 has a notch 107 (see FIG. 1) at which the tensile component 30 extends transversely inward at and borders the medial protrusion 102.

A lateral protrusion 108 of the peripheral flange 26 protrudes transversely inward at the lateral side 29 of the peripheral flange 26 to further define the boundary between the toe section 104 and the metatarsal section 106 as the lateral protrusion 108 falls along the metatarsophalangeal joint line 90. The outer edge 36 of the tensile component 30 has a notch 109 (see FIG. 1) at which the tensile component 30 extends transversely inward at and borders the lateral protrusion 108. Because the peripheral flange 26 is simply the polymeric material of the bladder 14 with no fluid-filled interior cavity 24 between the sheets 16, 18 of the peripheral flange 26, the peripheral flange 26 is thinner (e.g., lower height) than the inflated part of the bladder 14 (e.g., at the interior cavity 24) and so is more easily flexed at the protrusions 102, 108.

Additionally, the peripheral flange 26 has a front protrusion 110 protruding rearward from a front 112 of the peripheral flange 26 as shown in FIG. 3. The front protrusion 110 may fall along the boundary 94 between the hallux portion 86 and the second toe portion 88 of the forefoot region 23. The outer edge 36 of the tensile component 30 has a notch 113 at which the tensile component 30 extends rearward and borders the front protrusion 110. Because the foot F naturally flexes at the metatarsophalangeal joint and between the hallux and the second toe, providing the inward protrusions 102, 108, and 110 and notches 107, 109, and 113 in the tensile component 30 at corresponding locations enhances flexibility while still providing cushioning and flexibility under the toes and the metatarsal heads of the foot F.

In addition to the bonds of the first polymeric sheet 16 to the second polymeric sheet 18 at the first bond 54, the second bond 58, and the central bond 100 (if the aperture 96 is present), the bladder 14 may also have one or more inwardly-protruding partial welds, also referred to as partial bonds, that reduce the thickness (e.g., the height) of the bladder 14 at the partial bond without bonding the inner surfaces 38, 40 to one another. This increases flexibility and promotes flexing of the bladder 14 at the partial weld. For example, referring to FIG. 3, the first polymeric sheet 16 may be joined to the first tensile layer 42 at a first partial bond 66 that protrudes inward from the first polymeric sheet 16 toward the second polymeric sheet 18 only partially across the plurality of tethers 46. Because it extends only partially across the tethers 46 toward the second sheet 18, the fluid-filled interior cavity 24 is present between the sheets 16, 18 at the first partial bond 66. The first partial bond 66 thus creates a narrowing of but not a closure of the interior cavity 24. If a cross-section is taken across the partial bond 66, perpendicular to the cross-section shown in FIG. 8, the height of the bladder 14 is greater on either side of the first partial bond 66 at such a cross-section, similar to the height of the bladder 14 being greater on either side of transverse partial bond 120 as shown in FIG. 5. Because a lower height bladder 14 is easier to flex than a bladder 14 with a greater height, assuming equal fluid pressures, the inflated bladder 14 is easier to flex at the narrowed interior cavity 24 under the first partial bond 66 (e.g., at the reduced height of the bladder 14 at the first partial bond 66). The first partial bond 66 extends across the first polymeric sheet 16 from the first bond 54 to the second bond 58, thereby creating a location at which bending (e.g., flexing) of the bladder 14 will most easily occur. The reduced thickness of the bladder 14 is uninterrupted from the first bond 54, along the first partial bond 66, to the second bond 58.

Similarly, the first polymeric sheet 16 may be joined to the first tensile layer 42 at a transverse partial bond 120 that protrudes inward from the first polymeric sheet 16 toward the second polymeric sheet 18 only partially across the plurality of tethers 46. The transverse partial bond 120 is shown in FIG. 3 and in cross-section at both FIGS. 5 and 7, and extends from the lateral protrusion 108 to the medial protrusion 102, interrupted only by the central bond 100 in examples having such. The transverse partial bond 120 extends along the metatarsophalangeal joint line 90 to track the metatarsophalangeal joints of an overlying foot F. If the aperture 96 and central bond 100 are present, the transverse partial bond 120 may extend to the central bond 100. For example, a lateral portion 120A of the transverse partial bond 120 may extend from the lateral protrusion 108 to the central bond 100, and a medial portion 120B of the transverse partial bond 120 may extend from the medial protrusion 102 to the central bond 100.

The bladder 14 may also have a front partial bond 122 at which the first polymeric sheet 16 is joined to the first tensile layer 42. The front partial bond 122 protrudes inward from the first polymeric sheet 16 toward the second polymeric sheet 18 only partially across the plurality of tethers 46. The front partial bond 122 extends from the front protrusion 110 rearward toward the transverse partial bond 120. In examples in which the aperture 96 and central bond 100 are present, the front partial bond 122 extends to the central bond 100. Accordingly, both the transverse partial bond 120 and the front partial bond 122 extend from the respective inward protrusions 102, 108, and 110 of the peripheral flange 26 to the central bond 100. In an example of a strobel with a bladder alike in all aspects to bladder 14 except that the aperture 96 and the central bond 100 are not present, the front partial bond 122 would extend to the transverse partial bond 120 as the transverse partial bond 120 would not be interrupted by any central bond 100.

Additional partial bonds that protrude inward from the first polymeric sheet 16 toward the second polymeric sheet 18 only partially across the plurality of tethers 46 may include a toe joint partial bond 124 and/or a middle partial bond 126. The toe joint partial bond 124 extends forward of and is non-intersecting with the transverse partial bond 120 and non-intersecting with the front partial bond 122. The toe joint partial bond 124 is configured to align with and underlie an overlying joint of a hallux of the foot F forward of the metatarsophalangeal joint of the overlying foot F.

The middle partial bond 126 extends rearward of the transverse partial bond 120 and forward of the first partial bond 66, and is non-intersecting with the transverse partial bond 120 and the first partial bond 66. The middle partial bond 126 is disposed between the medial side 31 of the peripheral flange 26 and the lateral side 29 of the peripheral flange 26 without extending completely to either side 29, 31. The middle partial bond 126 has a medial end 126A terminating transversely inward of and spaced apart from the medial side 31 of the peripheral flange 26, and a lateral end 126B terminating transversely inward of and spaced apart from the lateral side 29 of the peripheral flange 26. Accordingly, the interior cavity 24 completely surrounds the middle partial bond 126 such that the middle partial bond 126 does not fluidly isolate a portion of the interior cavity 24 forward of the middle partial bond 126 from a portion of the interior cavity 24 rearward of the middle partial bond 126.

Although the tethers 46 may be originally of the same length and the outer surfaces 48, 52 of the first and second tensile layers 42, 44 and the exterior surfaces 21, 20 of the first and second polymeric sheets 16, 18, respectively, may originally be generally flat directly above the tethers (e.g., not contoured) prior to forming the strobel 10, the partial bonds 66, 120, 122 124, and 126 that join the first polymeric sheet 16 to the first tensile layer 42 protrude inward from the first polymeric sheet 16 toward the second polymeric sheet 18 directly into a region of the interior cavity 24 occupied by some of the tethers 46. Each partial bond 66, 120, 122 124, and 126 protrudes farther toward the second polymeric sheet 18 than the first surface bond 49. The partial bonds 66, 120, 122 124, and 126 protrude inward from the first polymeric sheet 16 only partially across the plurality of tethers 46 toward the second polymeric sheet 18, and the polymeric bladder 14 is narrowed at the partial bonds 66, 120, 122 124, and 126. For example, the partial bonds 66, 120, 122 124, and 126 (as well as the bond at the peripheral flange 26, the first and second bonds 54, 58, and the central bond 100) may be formed by a welding process, such as radio frequency or ultrasonic welding using tooling that results in thermal bonds in the polymeric bladder 14. Each partial bond 66, 120, 122 124, and 126 results from a respective protrusion of a mold component such as a mold insert. The mold component has a pattern of protrusions in a spacing that result in the partial bonds 66, 120, 122 124, and 126. The protrusions contact the first polymeric sheet 16 during manufacturing of the bladder 14.

The partial bonds 66, 120, 122 124, and 126 result in depressed grooves 132 at the foot-receiving surface 21 of the first polymeric sheet 16 (see FIGS. 5, 7, 8, and 9). One depressed groove 132 is shown in FIG. 5 at the lateral portion 120A of the partial bond 120. FIG. 7 is taken along the length of the medial portion 120B of the partial bond 120. Accordingly, the portion of FIG. 7 to the left of the central bond 100 is along the length of a depressed groove 132, as indicated by the lesser height H2 of the left portion in comparison to the height H1 of the portion to the right of the central bond 100. FIG. 8 is likewise taken along a length of the partial bond 66 and therefore along a length of the depressed groove 132, as indicated by the lower height H2. In the example shown, the partial bonds 66, 120, 122 124, and 126 are only at the first polymeric sheet 16 protruding inward toward the second polymeric sheet 18, as a mold component placed adjacent the second sheet 18 has no protrusions aligned with the tensile component 30. Optionally, the mold component placed adjacent to the second sheet 18 could also have protrusions to result in partial bonds extending inward toward the first sheet 16 from the second sheet 18.

Each partial bond 66, 120, 122 124, and 126 partially traverses the plurality of tethers 46 as shown with respect to partial bond 120 in FIG. 5. Stated differently, the partial bonds 66, 120, 122 124, and 126 are directly outward of different ones of the tethers 46 and protrude inward on those tethers 46. The tethers 46 may be arranged in rows, with each row extending transversely between the tensile layers 42, 44, or in any other pattern in which the tethers 46 extend between the tensile layers 42, 44. Various different ones of the tethers 46 are aligned with the partial bonds 66, 120, 122 124, and 126.

Tethers 46 that are aligned with the partial bonds 66, 120, 122 124, and 126 are deformed by heat, by compression of the overlaying material of the first tensile layer 42, and/or by the overlaying material of the first tensile layer 42 coating the tethers 46 such that the tethers 46 are shorter, thicker, or both shorter and thicker at the partial bonds 66, 120, 122 124, and 126 than elsewhere (e.g., than away from the partial bonds 66, 120, 122, 124, and 126). Such deformed tethers are indicated with reference numeral 46A in FIG. 5 and may be referred to as modified tethers 46A.

When the interior cavity 24 is inflated, the modified tethers 46A result in the depressed grooves 132 in the foot-receiving surface 21 of the first polymeric sheet 16 as indicated in FIG. 5. When an inflation pressure of the gas in the interior cavity 24 is sufficient to tension the plurality of tethers 46, the inwardly-protruding partial bonds 66, 120, 122 124, and 126 define grooves 132 at the foot-receiving surface 21 of the first polymeric sheet 16. At each depressed groove 132, the strobel 10 is divided into what may be referred to as a first article portion on one side of the depressed groove 132 and a second article portion on the other side of the depressed groove 132. The first article portion is articulated relative to the second article portion along the depressed groove 132. Stated differently, the foot-receiving surface 21 of the first polymeric sheet 16 is non-planar at the depressed groove 132.

The tension of the modified tethers 46A also causes recesses 136 in the ground-facing surface 20 of the second polymeric sheet 18 that are aligned with the depressed grooves 132 (see FIGS. 5, 7, 8, and 9). The second polymeric sheet 18 is recessed inward toward a corresponding depressed groove 132 and inwardly-protruding partial bond 66, 120, 122 124, or 126 at each recess 136 when the interior cavity 24 is inflated.

The physical deformation of the first polymeric sheet 16 and the first tensile layer 42 combined with the tension of the modified tethers 46A will cause the depressed grooves 132 to be deeper than the recesses 136, which result only from the tension of the shortened modified tethers 46A. Accordingly, the bladder 14 may have an articulated shape (such as when inflated, not assembled with or constrained by other components, and not under loading), causing the bladder 14 to be slightly concave at the foot-receiving surface 21 and slightly convex at the ground-facing surface 20. The strobel 10 will thus be biased to an articulated shape, as the depressed grooves 132 and recesses 136 together encourage articulation of the strobel 10 to occur at the depressed grooves 132, as the overall thickness of the strobel 10 is reduced at the depressed grooves 132, decreasing bending stiffness of the strobel 10 at the depressed grooves 132. Due to the depressed grooves 132 and the further narrowing of the bladder 14 by the corresponding recesses 136, as discussed above, the inwardly-protruding partial bonds 66, 120, 122, 124, and 126 act as flexion axes of the bladder 14 thereby increasing flexibility of the sole structure 15 when the strobel 10 is included in the sole structure 15 of the article of footwear 12.

Each partial bond 66, 120, 122, 124, and 126 is spaced apart from the second polymeric sheet 18 such that the interior cavity 24 is narrowed but not closed at the partial bond 66, 120, 122, 124, and 126, and the gas in the interior cavity 24 can still fluidly communicate across the partial bond 66, 120, 122, 124, and 126. The modified tethers 46A are narrow in diameter and allow gas to flow around and between the tethers 46A. This allows the gas to be displaced from the interior cavity 24 at one side of the tethers 46A to the interior cavity 24 at the other side of the tethers 46A when compressive forces are applied to the strobel 10, such as during impact of the article of footwear 12 with the ground. For example, as a foot F rolls forward from heel to toe during a foot strike, the gas may be displaced from rearward in the bladder 14 to a portion more forward in the bladder 14. Supportive cushioning provided by the fluid in the interior cavity 24 can thus be continuously provided in areas most needed during use of the strobel 10.

Factors that may influence the partial bonds 66, 120, 122, 124, and 126 and the extent of their protrusion toward the second polymeric sheet 18 can be controlled to provide a desired narrowing. Such factors may include the depth of the protrusions 128 that create the partial bonds 66, 120, 122, 124, and 126, the temperature of the mold components, the temperature of the components of the strobel 10 (e.g., the polymeric sheets 16, 18 and the tensile component 30), vacuum and/or inflation pressures in the mold cavity during manufacturing, the weld power or weld frequency if radio frequency welding is used, and other factors.

Other aspects of the bladder 14 may enable its easy integration within the article of footwear 12. For example, as shown in FIG. 3, the peripheral flange 26 is wider forward of the first bond 54 than rearward of the first bond 54 at both the medial side 31 and the lateral side 29. The wider peripheral flange 26 in this area enables it to be easily stitched or otherwise secured to the footwear upper 13. Additionally, the peripheral flange 26 defines a groove 140 extending lengthwise along the peripheral flange 26 from the medial side 31 to the lateral side 29 and forward of the first bond 54. The groove 140 may serve as a visible path for a needle to follow when stitching the upper 13 to the peripheral flange 26 of the bladder 14, for example.

Figure 6:
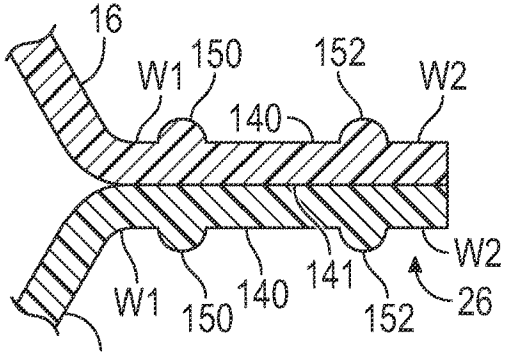
FIG. 6 is a fragmentary view of a portion of the strobel of FIG. 3 taken at lines 6-6 in FIG. 3 and showing a peripheral flange of the strobel.

With reference to FIG. 6, the peripheral flange 26 has a first weld W1 and a second weld W2 spaced apart from the first weld W1. The first weld W1 and the second weld W2 cause the first and second polymeric sheets 16, 18 to bond to one another at an interface 141 at the welds W1, W2. The welds W1 and W2 may be formed by using a mold assembly that includes mold components closed together on the polymeric sheets 16, 18, with the tensile component 30 between the polymeric sheets 16, 18. The polymeric sheets 16, 18 and tensile component 30 are then welded by radio frequency welding (also referred to as high frequency or dielectric welding) or are secured by another manner of thermal or adhesive bonding, as a power source supplies energy creating an alternating electric field that heats the polymeric sheets 16, 18 where mold components are applied to the polymeric sheets 16, 18. In an example with welds W1, W2 on both sides of the peripheral flange 26 as in FIG. 6, mold components on both sides of the peripheral flange 26 would include ridges that cause the respective welds W1, W2. In other examples, the welds W1, W2 and groove 140 may be only on the top side or only on the bottom side of the flange 26. Because the polymeric sheets 16, 18 may be transparent, the groove 140 may be visible on the opposite side when only provided on one side.

The first weld W1 and the second weld W2 extend lengthwise along the peripheral flange 26. As best shown in FIG. 3, the first weld W1 and the second weld W2 extend continuously along only the wider portion of the peripheral flange 26 (from the location 151 on the medial side 31, around the front of the bladder 14, to the location 153 on the lateral side 29. The groove 140 extends lengthwise along the peripheral flange 26 between the first weld W1 and the second weld W2. The first weld W1 is inward of the groove 140 and the second weld W2 is outward of the groove 140 where inward is toward the center of the bladder 14 and outward is away from the center of the bladder 14.

Referring to FIGS. 3 and 6, heating and pressure of the mold assembly at the welds W1 and W2 may displace some of the material of the polymeric sheets 16, 18 so that the peripheral flange 26 may include a first ridge 150 protruding from the peripheral flange 26 between the first weld W1 and the groove 140, and a second ridge 152 protruding from the peripheral flange 26 between the second weld W2 and the groove 140. The ridges 150, 152 help to define the sides of the groove 140.

The strobel 10 may be disposed in the sole structure 15 for a right foot article of footwear 12 as in FIG. 1, or may be flipped over for disposing in a sole structure for a left foot article of footwear. In either case, one of the two grooves 140 will be in the same position relative to the upper 13 in both instances to serve as a guide for stitching or other securement modes. In examples having a groove 140 on only one of the sides (in the top sheet 16 or the bottom sheet 18) of the peripheral flange 26, because the polymeric sheets 18, 16 may be transparent, the groove 140 may be visible at the distal side even in examples in which a groove 140 is provided only on the proximal side and vice versa.

Referring to FIGS. 9 and 10, the sole plate 17 includes a plurality of upwardly-extending support ribs 51 extending upward from a base 55 of the sole plate 17 and arranged in a web pattern. The support ribs 51 define a plurality of recesses 53 between the support ribs 51 and extending downward toward the base 55. The support ribs 51 stiffen the sole plate 17 while the recesses 53 allow the stiffening to be accomplished without the addition of excess weight. As shown in FIG. 9, a portion of the bladder 14 may rest on and be adhered or otherwise secured to the support ribs 51.

As shown in FIG. 10, the forefoot portion 17A of the sole plate 17 includes a medial arm 59 and a lateral arm 61 spaced apart from the medial arm 59 to define a central gap 63 in the forefoot portion 17A. As best shown in FIG. 5, the central gap 63 corresponds with the aperture 33 in the upper 13 and the polymeric bladder 14 spans the central gap 63. Because the sole plate 17 does not underlie that portion of the polymeric bladder 14 that spans the central gap 63 (e.g., the portion of the bladder 14 directly above the central gap 63), the overall height of the sole structure 15 at the spanning portion of the polymeric bladder 14 is only the height H1 of the bladder 14 plus any additional height that would be added by an optional cover layer above or below the bladder 14. This is less than a height H3 of the sole structure 15 at the medial arm 59, for example. The lower height H1 helps to increase flexibility and decrease bending stiffness of the sole structure 15. The arms 59, 61, however, still provide lateral and medial stability in the forefoot region 23, such as may be desirable to absorb lateral loads and support the foot F during side (transverse) movements.

The rear extent 95 of the polymeric bladder 14 shown in FIG. 3 may be secured to the heel portion 17C of the sole plate 17 rearward of the central gap 63 shown in FIG. 10, such as at location 65. The connection of the bladder 14 rearward of the central gap 63 as well as laterally outward of the central gap 63 (e.g., to the medial and lateral arms 59, 61) may provide a trampoline-like effect during dynamic compressive loading of the bladder 14 as it is relatively suspended over the central gap 63, with the sole plate 17 serving as a frame.

Figure 11:
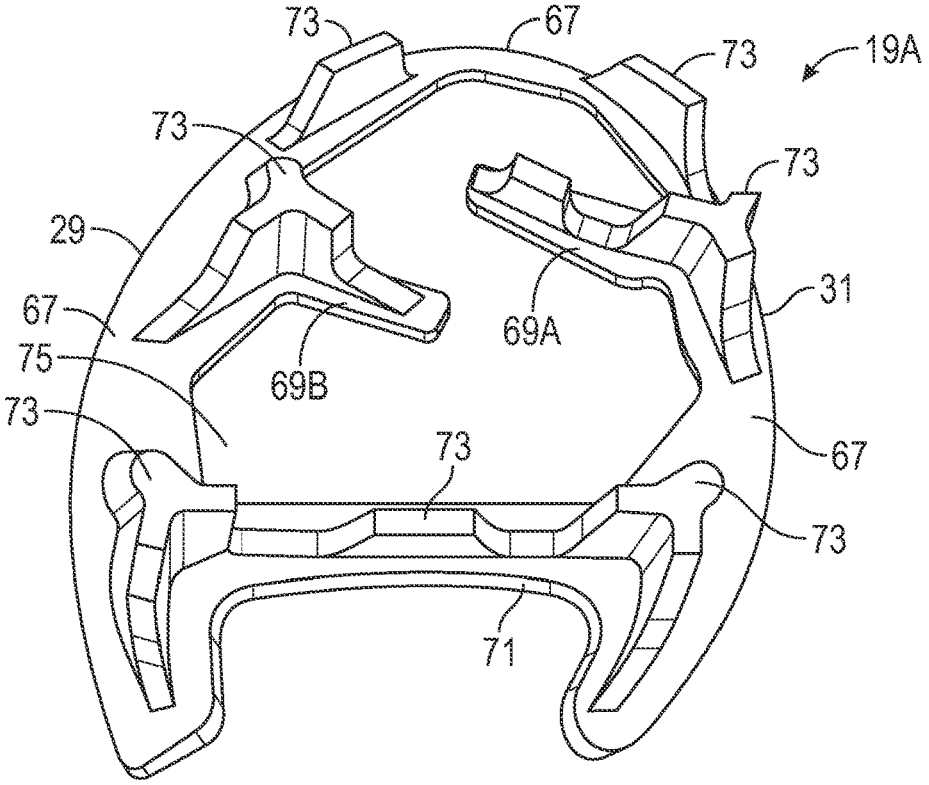
FIG. 11 is a bottom perspective view of a forefoot outsole included in the article of footwear of FIG. 1.

Referring to FIG. 11, the forefoot outsole 19A has a peripheral rim 67, transverse arms 69A, 69B, and a transverse bar 71. Cleats 73 extend downward from the peripheral rim 67, the transverse arms 69A, 69B, and the transverse bar 71. The peripheral rim 67 defines a forefoot aperture 75. The forefoot aperture 75 underlies the central gap 63, as shown in FIG. 5. The forefoot aperture 75 of the forefoot outsole 19A thus further complements the central gap 63 in the forefoot portion 17A of the sole plate 17 and its ability to allow a trampoline effect of the bladder 14 at the central gap 63.

Moreover, the transverse arms 69A, 69B extend transversely inward from the peripheral rim 67 into the forefoot aperture 75 of the forefoot outsole 19A and under the central gap 63 of the sole plate 17. For example, the medial transverse arm 69A extends transversely inward from the medial side 31 of the forefoot outsole 19A and terminates in the forefoot aperture 75. The lateral transverse arm 69B extends transversely inward from the lateral side 29 of the forefoot outsole 19A and terminates in the forefoot aperture 75, and is rearward of the medial transverse arm 69A. As shown in FIG. 2, the transverse arms 69A, 69B may be secured to the ground-facing surface 20 of the bladder 14, and provide targeted support under the bladder 14 to the overlying foot F. The medial transverse arm 69A underlies the hallux portion 86 of the bladder 14, and the lateral transverse arm 69B underlies the remainder of the toe section 104, including the second toe portion 88. The transverse arms 69A, 69B are thus configured to align with toes of the overlying foot F to assist in providing a stable platform for toe off, while leaving the area of the central gap 63 aligned with metatarsal heads of the foot F unobstructed by any underlying portion of the forefoot outsole 19A for a cushioned feel under the metatarsal heads. With no transverse arm extending completely across the forefoot aperture 75, and with the transverse arms 69A, 69B decoupled from one another, the transverse arms 69A, 69B complement the function of the front partial bond 122 in decoupling of the hallux portion 86 from the second toe portion 88 for natural foot flexibility.

Figure 12:
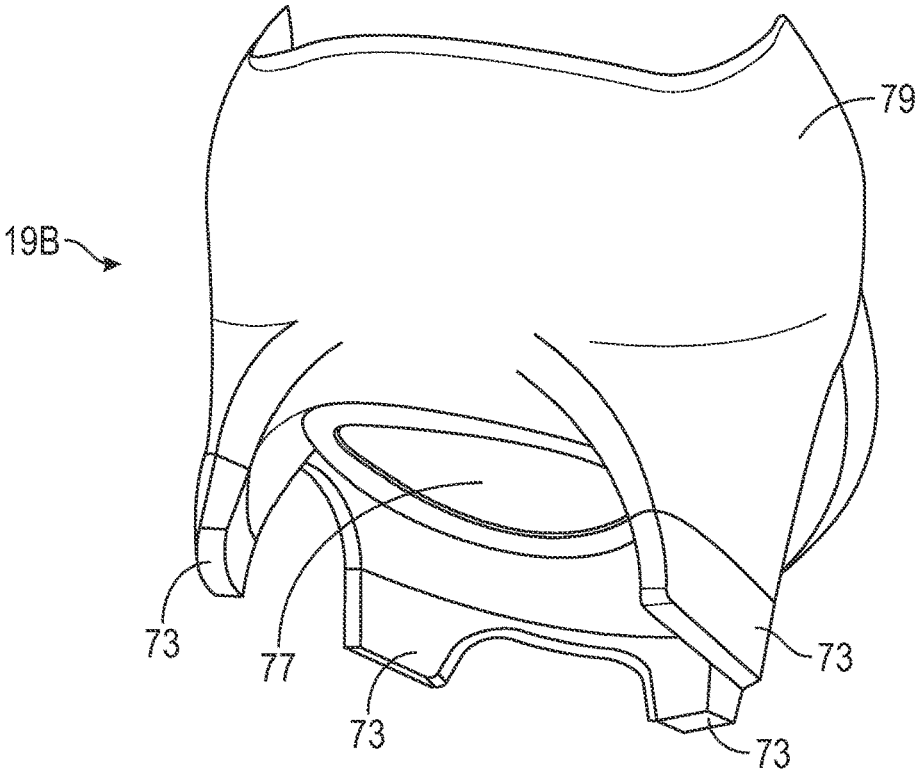
FIG. 12 is a rear perspective view of a heel outsole included in the article of footwear of FIG. 1.

The transverse bar 71 spans from the medial side 31 of the peripheral rim 67 to the lateral side 29 of the peripheral rim 67 and is disposed rearward of the transverse arms 69A, 69B. Furthermore, the transverse bar 71 is spaced rearward from the transverse partial bond 120 and the central bond 100, as shown in FIG. 2, and is configured to be disposed rearward of the metatarsal heads of the overlying foot F which would fall between the transverse partial bond 120 and the transverse bar 71 in FIG. 2. This provides greater cushioning under the metatarsal heads by transferring impact loads from ground contact by the cleats 73 to the surrounding transverse bar 71 and to the peripheral rim 67 and the transverse arms 69A, 69B, for example, away from the metatarsal heads Referring to FIG. 12, the heel outsole 19B also includes cleats 73 and has a central vertical through hole 77. As shown in FIG. 2, the central vertical through hole 77 extends to the overlying upper 13. The central vertical through hole 77 minimizes the overall weight of the heel outsole 19B. As the cleats 73 ring the central vertical through hole 77, and the central vertical through hole 77 is configured to underlie the calcaneus of the foot F, impact loads transferred through the cleats 73 to the heel portion 17C of the sole plate that overlies the upper 13 above the heel outsole 19B may be transferred around but not directly under a center of the heel (e.g., the calcaneus) of the overlying foot F. An upper portion 79 of the heel outsole 19B cups the foot F outward of the upper 13 in the heel region 27, as shown in FIG. 1.

Figure 13:
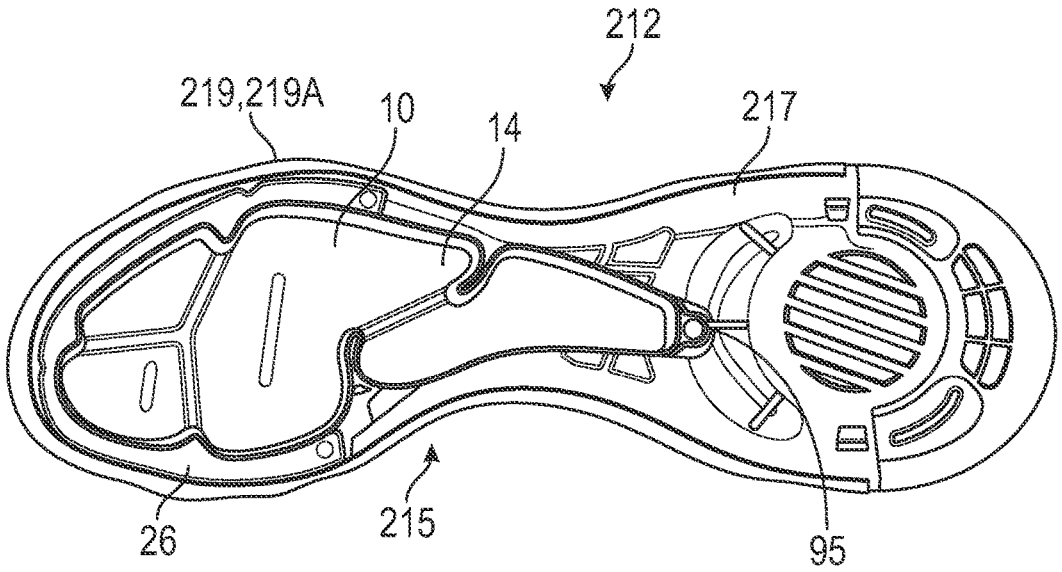
FIG. 13 is a plan view of a sole structure for another example of an article of footwear including the strobel of FIG. 3.

Referring to FIG. 13, a sole structure 215 for another example of an article of footwear 212 includes the strobel 10 of FIG. 3, and an alternative sole plate 217 and outsole 219. Only an upper edge of a front outsole 219A is shown in FIG. 13, and the front outsole 219A extends under the sole plate 217, as is evident with the strobel 10 removed in FIG. 14. Accordingly, the bladder 14 will not be exposed at the bottom of the footwear 212. The upper 13 (not shown in FIGS. 13 and 14) is stitched to the peripheral flange 26 similar to the stitching shown by tensile member 35 in FIG. 5. The footwear upper 13 may extend under the sole plate 217 similar to footwear upper 13 extending under the sole plate 17 in FIG. 5, or the footwear upper 13 may extend between the bladder 14 and the sole plate 17 similar to the upper 13 extending between the bladder 14 and the sole plate 317 in FIGS. 20-21.

Figure 14:
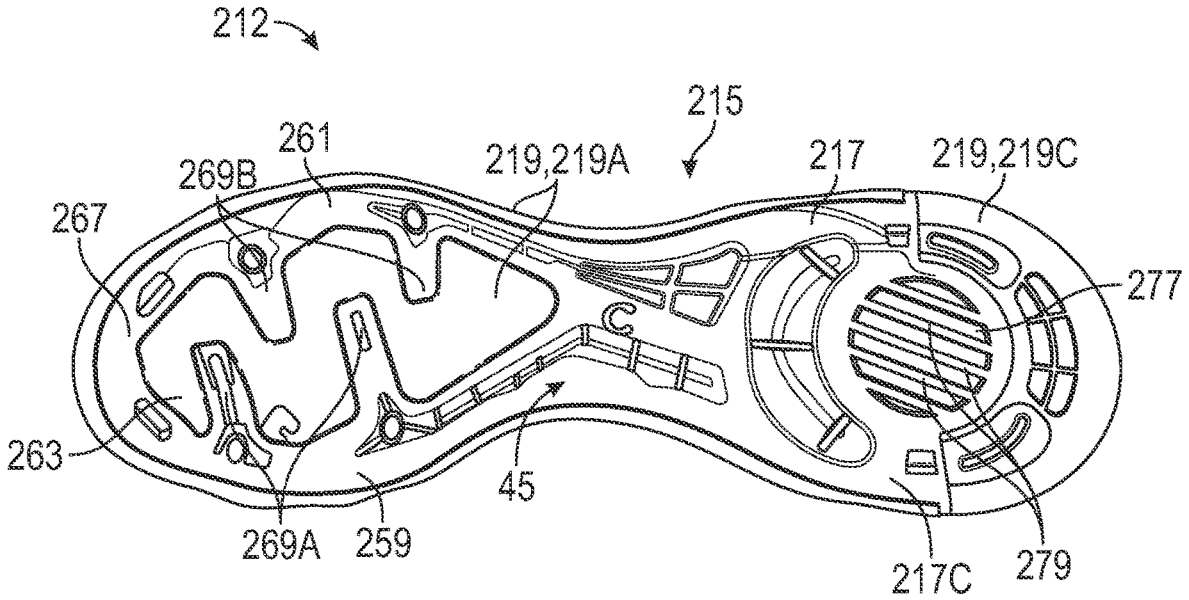
FIG. 14 is a plan view of the sole structure of FIG. 13 with the strobel removed.

As shown in FIG. 14, the sole plate 217 extends only partially into the heel region 27, and the front outsole 219A is coupled to a heel outsole 219C that extends further rearward than the rear of sole plate 217. The sole plate 217 includes a medial arm 259 and a lateral arm 261, similar to the arms 59, 61 of sole plate 17, but these are connected at the front of the sole plate by a continuous peripheral rim 267 to surround a central gap 263 of the sole plate 217. Two medial transverse arms 269A and two lateral transverse arms 269B extend transversely inward and terminate in the central gap 263 to provide targeted support under the bladder 14 to the overlying foot F shown in FIG. 1. Each lateral transverse arm 269B is rearward of a corresponding medial transverse arm 269A.

Rather than a central through hole in a heel outsole as in heel outsole 19B, the heel portion 217C of the sole plate 217 defines a through hole 277 that is traversed by a plurality of slats 279. The slats 279 provide stiffening with minimal added material. A foam layer (not shown) may overlie the slats 279 rearward of the bladder 14.

Figure 15:
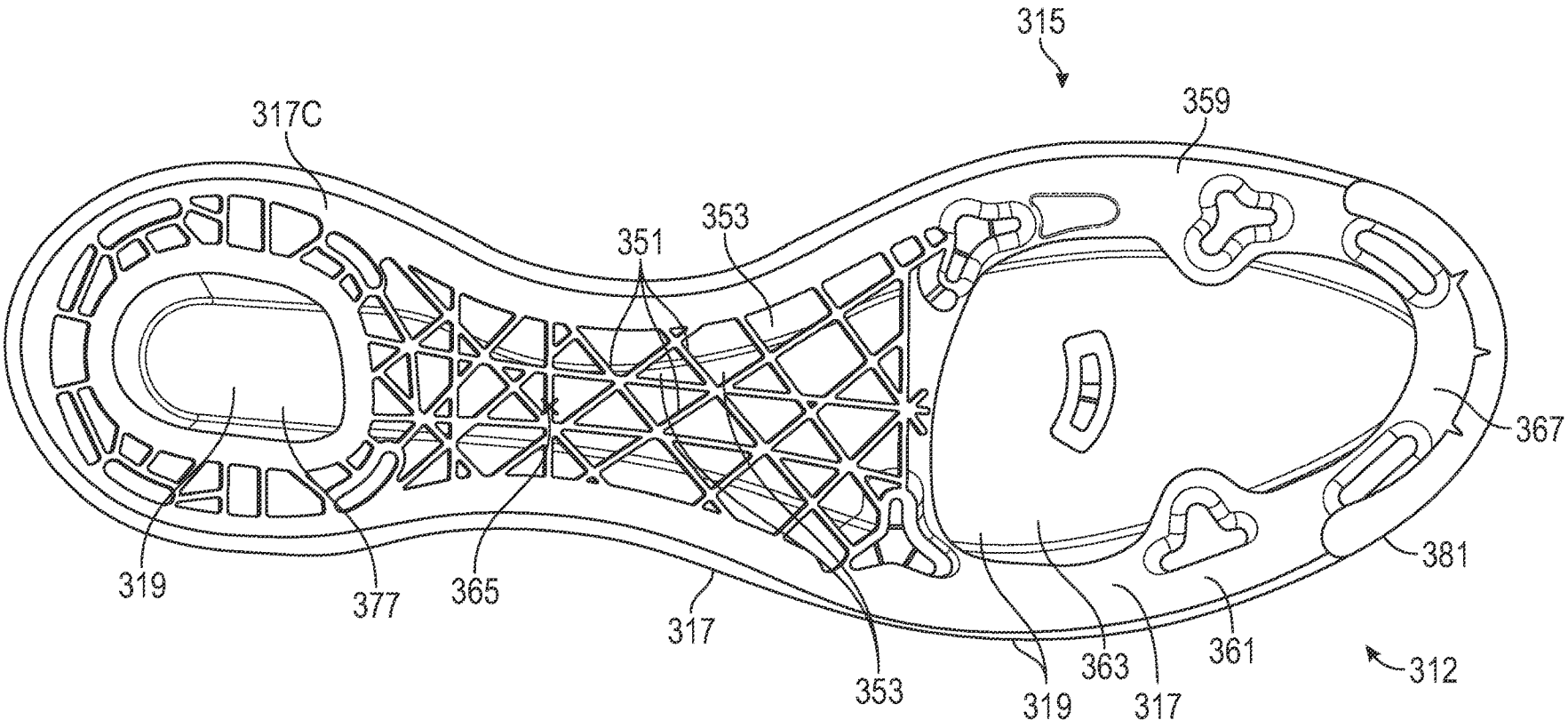
FIG. 15 is a plan view of a sole structure for an article of footwear shown in FIG. 16 with a strobel like that of FIG. 1 removed.
Figure 19:
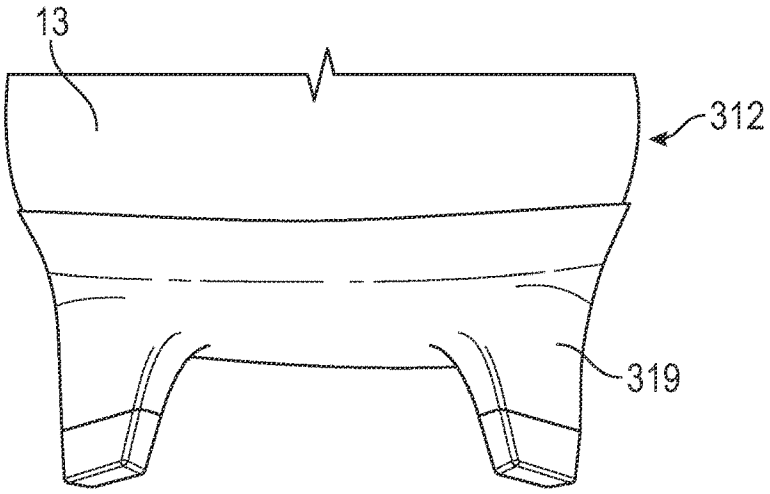
FIG. 19 is a fragmentary rear view of the article of footwear of FIG. 16.
Figure 20:
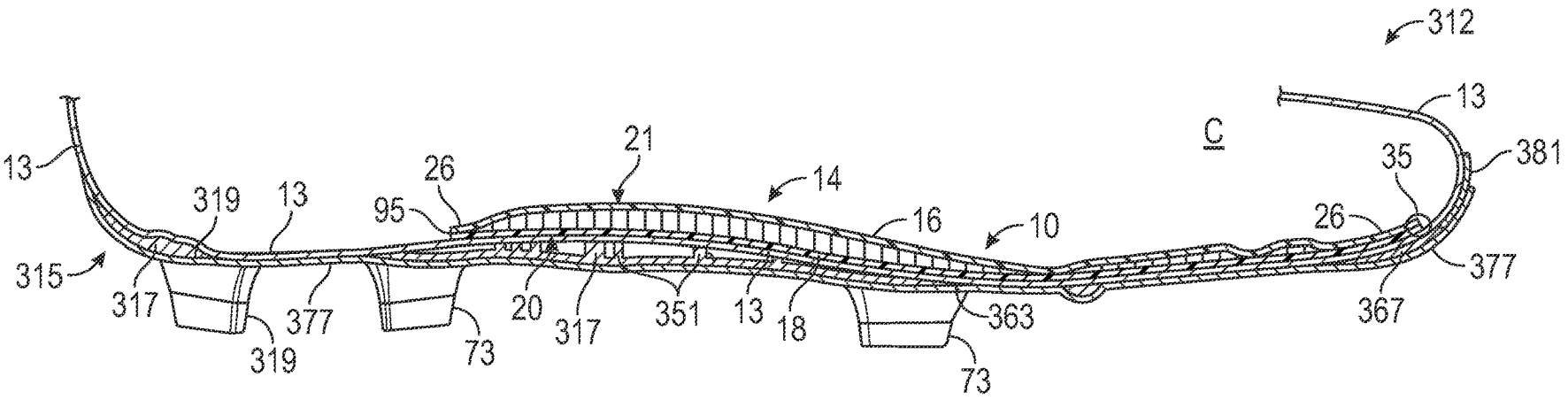
FIG. 20 is a cross-sectional view of the article of footwear of FIG. 16 taken at lines 20-20 in FIG. 16.
Figure 21:
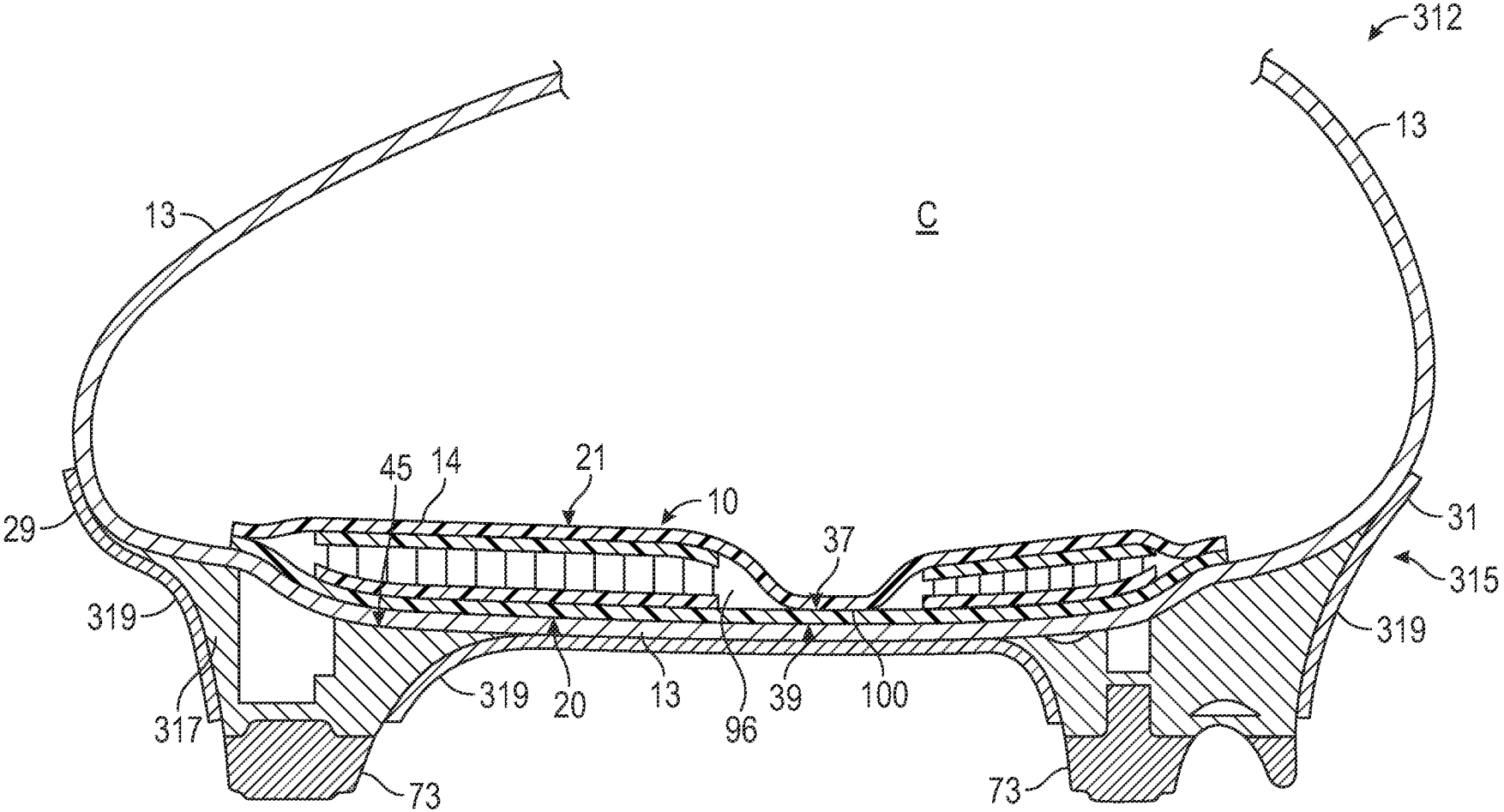
FIG. 21 is a cross-sectional view of the article of footwear of FIG. 16, taken at lines 21-21 in FIG. 16.

FIG. 15 is a plan view of another sole structure 315 for an article of footwear 312 shown in FIGS. 16-21. The article of footwear 312 includes the strobel 10, as shown in FIGS. 20-21, but the strobel 10 is removed in FIG. 15. The sole structure 315 includes a sole plate 317 and an outsole 319 underlying the sole plate 317. The sole plate 317 has upwardly-extending support ribs 351 arranged in a web pattern and similar in function to the support ribs 51 of FIG. 10, with recesses 353 defined between the support ribs 351.

Additionally, the sole plate 317 has a medial arm 359 and a lateral arm 361, similar to the arms 59, 61 of sole plate 17, but arms 359, 361 are connected at the front of the sole plate 317 by a continuous peripheral rim 367 to surround a central gap 363 of the sole plate 317. A toe guard 381 extends over a front extent of the sole plate 317. The heel portion 317C of the sole plate 317 defines a through hole 377. The outsole 319 underlies both of the central gap 363 and the through hole 377.

The strobel 10 is positioned to overlie the sole plate 317, spanning the central gap 363, with the flange 26 supported on the medial arm 359, the lateral arm 361, and the peripheral rim 367, and the rear extent 95 of the strobel 10 secured to the sole plate 317 at position 365.

Figure 16:
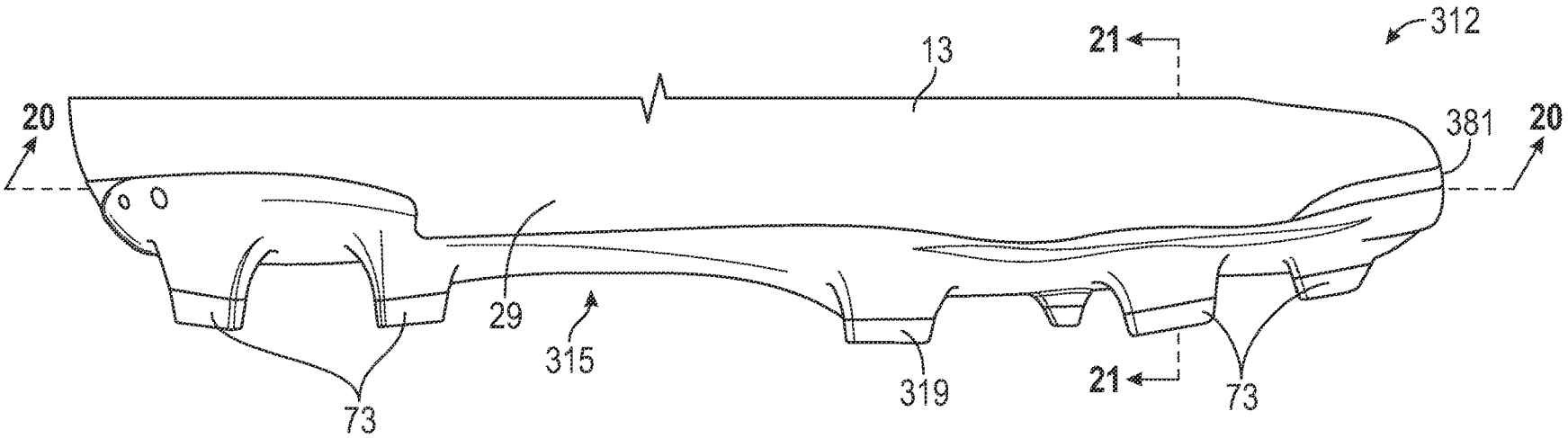
FIG. 16 is a fragmentary lateral view of an article of footwear including the sole structure of FIG. 15.
Figure 17:
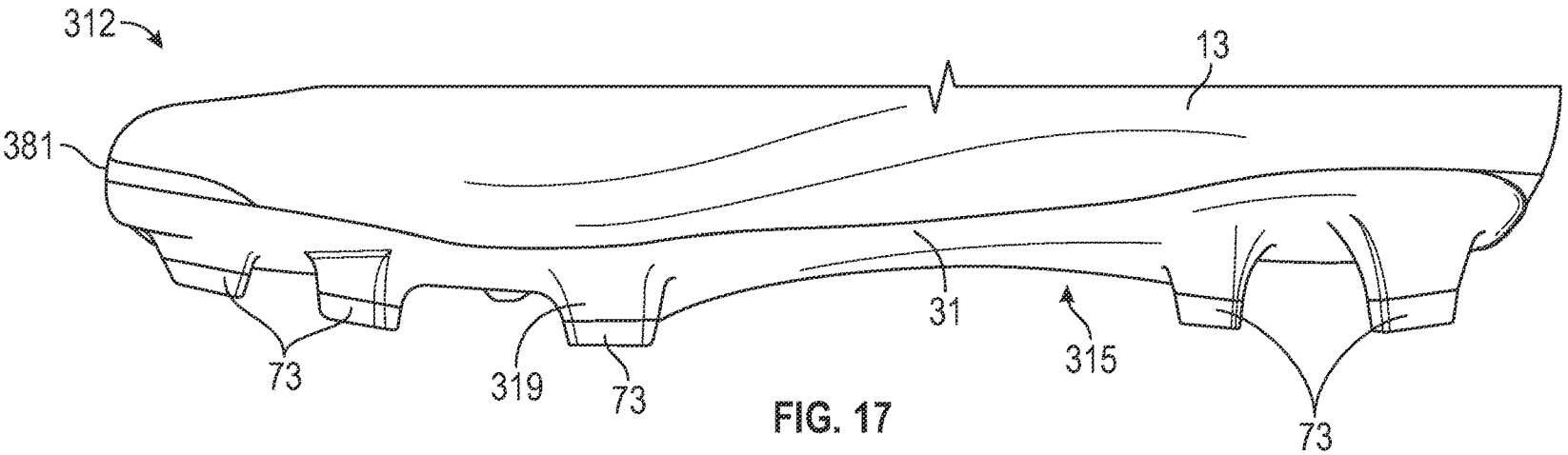
FIG. 17 is a fragmentary medial view of the article of footwear of FIG. 16.
Figure 18:
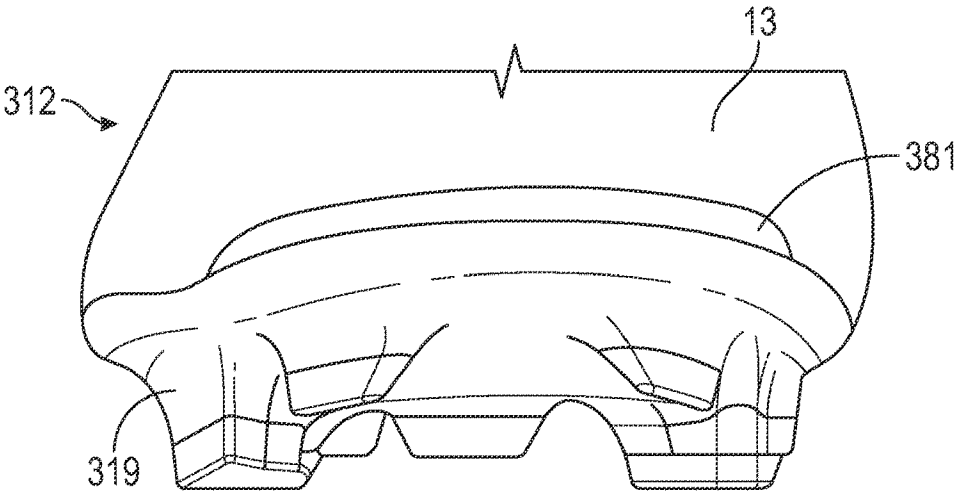
FIG. 18 is a fragmentary front view of the article of footwear of FIG. 16.

FIG. 16 is a fragmentary lateral view of the lateral side 29 of the article of footwear 312 including the sole structure 315 of FIG. 15. FIG. 17 is a fragmentary medial view of the medial side 31 of the article of footwear 312. It is clear in FIGS. 16-17 that the outsole 319 has cleats 73. FIG. 18 is a fragmentary front view of the article of footwear 312 of FIG. 16, showing the toe guard 381. FIG. 19 is a fragmentary rear view of the article of footwear of FIG. 16.

FIG. 20 is a cross-sectional view of the article of footwear of FIG. 16 taken at lines 20-20 in FIG. 16, and FIG. 21 is a cross-sectional view of the article of footwear of FIG. 16, taken at lines 21-21 in FIG. 16. Referring to FIGS. 20 and 21, the footwear upper 13 wraps under the strobel 10 between the medial side 31 and the lateral side 29 of the sole plate 317 so that the footwear upper 13 extends between the second polymeric sheet 18 of the polymeric bladder 14 (e.g., the bottom sheet) and the foot-facing surface 45 of the sole plate 317 and extends transversely outward of the polymeric bladder 14. The ground-facing surface 20 of the bladder 14 is secured to the inner surface 37 of the footwear upper 13, and the foot-facing surface 45 of the sole plate 317 is secured to the outer surface 39 of the foot wear upper 13. The outsole 319 is secured to the sole plate 317.

Accordingly, with reference to the above described examples, a method of manufacturing an article of footwear 12, 212, and 312, may include disposing a strobel 10 on a foot-facing surface 45 of a sole plate 17, 217 or on an inner surface 37 of a footwear upper 13. The strobel 10 may include a polymeric bladder 14 defining an interior cavity 24 and configured to retain a fluid in the interior cavity 24. The polymeric bladder 14 may have a peripheral flange 26 extending around an outer periphery 34 of the interior cavity 24 from a medial side 31 to a lateral side 29 of the polymeric bladder 14 at a front of the polymeric bladder 14. The sole plate 17, 217, and 317 may have a heel portion, a midfoot portion, and a forefoot portion. The method may include securing a rear extent 95 of the strobel 10 to the sole plate 17 or 217, or to a footwear upper 13, and forward of a rear extent 47 of the sole plate 217, or 317.

Additionally, the method may include securing the footwear upper 13 to the peripheral flange 26. In an example, securing the footwear upper 13 to the peripheral flange 26 may include stitching a tensile member 35 through the footwear upper 13 and the peripheral flange 26.

Prior to securing the footwear upper 13 to the peripheral flange 26, the method may include wrapping the footwear upper 13 under the sole plate 17 between a medial side 31 and a lateral side 29 of the sole plate 17 so that the footwear upper 13 extends transversely outward of the polymeric bladder 14 and the sole plate 17. Additionally, an outsole 19 may be secured to the footwear upper 13 under the sole plate 17.

In another example, prior to securing the footwear upper 13 to the peripheral flange 26, the method may include wrapping the footwear upper 13 under the strobel 10 between a medial side 31 and a lateral side 29 of the sole plate 217 or 317 so that the footwear upper 13 extends between the polymeric bladder 14 and the foot-facing surface 45 of the sole plate 217 or 317 and extends transversely outward of the polymeric bladder 14. Under the method, an outsole 219, 319 may be secured to the sole plate 217, 317.

The articles of footwear 12, 212, and 312 disclosed herein secure a fluid-filled bladder 14 configured as a strobel 10 secured to an upper 13 and, in some examples, to a sole plate (e.g., sole plate 17) to integrate the cushioning and energy return advantages of a bladder 14 and the stability of the sole plate 17, 217, or 317 with a low profile sole structure 15, 215, or 315 that flexes and articulates in a desired manner.

The above features and advantages and other features and advantages of the present teachings are readily apparent from the following detailed description of the modes for carrying out the present teachings when taken in connection with the accompanying drawings. It should be understood that, even though in the following drawings, embodiments may be separately described, single features thereof may be combined to additional embodiments.

The following Clauses provide example configurations of an article of footwear and a method of manufacturing an article of footwear disclosed herein.

Clause 1. An article of footwear comprising: a strobel including a polymeric bladder defining an interior cavity and configured to retain a fluid in the interior cavity, the polymeric bladder having a peripheral flange extending around a perimeter of the interior cavity from a medial side to a lateral side of the polymeric bladder at a front of the polymeric bladder; a footwear upper secured to the peripheral flange; a sole plate having a heel portion, a midfoot portion, and a forefoot portion; wherein a rear extent of the strobel is secured to the sole plate or to the footwear upper forward of a rear extent of the sole plate.

Clause 2. The article of footwear of clause 1, further comprising: a tensile member defining stitches extending through the footwear upper and the peripheral flange, the stitches securing the footwear upper to the peripheral flange.

Clause 3. The article of footwear of any of the preceding clauses, wherein the strobel tapers in transverse width so that a midfoot portion of the strobel is narrower than the midfoot portion of the sole plate underlying the midfoot portion of the strobel.

Clause 4. The article of footwear of any of the preceding clauses, wherein a rear extent of the strobel is secured to a foot-facing surface of the sole plate rearward of the forefoot portion of the sole plate and forward of a rear extent of the heel portion of the sole plate.

Clause 5. The article of footwear of any of the preceding clauses, wherein the footwear upper wraps under the sole plate between a medial side of the sole plate and a lateral side of the sole plate and extends transversely outward of the polymeric bladder and the sole plate.

Clause 6. The article of footwear of any of the preceding clauses, wherein the forefoot portion of the sole plate includes a medial arm and a lateral arm spaced apart from the medial arm to define a central gap in the forefoot portion of the sole plate; and wherein the polymeric bladder spans the central gap.

Clause 7. The article of footwear of clause 6, wherein a rear extent of the polymeric bladder is secured to the heel portion of the sole plate rearward of the central gap.

Clause 8. The article of footwear of any of the preceding clauses, further comprising: an outsole underlying the sole plate.

Clause 9. The article of footwear of clause 8, wherein the footwear upper is sandwiched between the outsole and the sole plate.

Clause 10. The article of footwear of clause 8, wherein the outsole includes a forefoot outsole underlying the forefoot portion of the sole plate and a heel outsole underlying the heel portion of the sole plate and decoupled from the forefoot outsole.

Clause 11. The article of footwear of clause 10, wherein the forefoot portion of the sole plate includes a medial arm and a lateral arm spaced apart from the medial arm to define a central gap in the forefoot portion of the sole plate; wherein the polymeric bladder spans the central gap; and wherein the forefoot outsole has a peripheral rim defining a forefoot aperture underlying the central gap of the sole plate.

Clause 12. The article of footwear of clause 11, wherein the forefoot outsole includes at least one transverse arm extending transversely inward from the peripheral rim into the forefoot aperture of the forefoot outsole and under the central gap of the sole plate.

Clause 13. The article of footwear of clause 12, wherein the at least one transverse arm includes a medial transverse arm extending transversely inward from a medial side of the forefoot outsole and terminating in the forefoot aperture, and a lateral transverse arm extending transversely inward from a lateral side of the forefoot outsole and terminating in the forefoot aperture, and the lateral transverse arm rearward of the medial transverse arm.

Clause 14. The article of footwear of clause 12, wherein the forefoot outsole includes a transverse bar spanning from a medial side of the peripheral rim of the forefoot outsole to a lateral side of the peripheral rim of the forefoot outsole rearward of the at least one transverse arm Clause 15. The article of footwear of clause 10, wherein the heel outsole includes a central vertical through hole.

Clause 16. The article of footwear of any of the preceding clauses, wherein the forefoot portion of the sole plate includes a medial arm and a lateral arm spaced apart from the medial arm to define a central gap in the forefoot portion of the sole plate; wherein the polymeric bladder spans the central gap; and wherein the sole plate includes at least one transverse arm extending transversely inward into the central gap of the sole plate.

Clause 17. The article of footwear of clause 16, wherein the at least one transverse arm includes a medial transverse arm extending transversely inward from a medial side of the sole plate and terminating in the central gap, and a lateral transverse arm extending transversely inward from a lateral side of the sole plate and terminating in the central gap, and the lateral transverse arm rearward of the medial transverse arm.

Clause 18. The article of footwear of any of the preceding clauses, wherein the sole plate includes a plurality of upwardly-extending support ribs arranged in a web pattern and defining a plurality of recesses between the support ribs.

Clause 19. The article of footwear of any of the preceding clauses, wherein the sole plate includes a plurality of slats in the heel portion of the sole plate.

Clause 20. A method of manufacturing an article of footwear, in particular according to any of the preceding clauses, the method comprising: disposing a strobel on a foot-facing surface of a sole plate or an inner surface of a footwear upper; wherein the strobel includes a polymeric bladder defining an interior cavity and configured to retain a fluid in the interior cavity, the polymeric bladder having a peripheral flange extending around a perimeter of the interior cavity from a medial side to a lateral side of the polymeric bladder at a front of the polymeric bladder; wherein the sole plate has a heel portion, a midfoot portion, and a forefoot portion; securing a rear extent of the strobel to the sole plate or to the footwear upper forward of a rear extent of the sole plate; and securing the footwear upper to the peripheral flange.

Clause 21. The method of manufacturing of clause 20, wherein securing the footwear upper to the peripheral flange includes stitching a tensile member through the footwear upper and the peripheral flange.

Clause 22. The method of manufacturing of any of the preceding clauses, further comprising: prior to securing the footwear upper to the peripheral flange, wrapping the footwear upper under the sole plate between a medial side of the sole plate and a lateral side of the sole plate so that the footwear upper extends transversely outward of the polymeric bladder and the sole plate.

Clause 23. The method of clause 22, further comprising: securing an outsole to the footwear upper under the sole plate.

Clause 24. The method of manufacturing of any of the preceding clauses, further comprising: prior to securing the footwear upper to the peripheral flange, wrapping the footwear upper under the strobel between a medial side of the sole plate and a lateral side of the sole plate so that the footwear upper extends between the polymeric bladder and the foot-facing surface of the sole plate and extends transversely outward of the polymeric bladder.

Clause 25. The method of clause 24, further comprising: securing an outsole to the sole plate.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a strobel including a polymeric bladder defining an interior cavity and configured to retain a fluid in the interior cavity, the polymeric bladder having a peripheral flange extending around a perimeter of the interior cavity from a medial side to a lateral side of the polymeric bladder at a front of the polymeric bladder;

a footwear upper secured to the peripheral flange; and a sole plate having a heel portion, a midfoot portion, and a forefoot portion;

wherein a rear extent of the strobel is secured to the sole plate or to the footwear upper forward of a rear extent of the sole plate; and wherein the strobel tapers in transverse width so that a midfoot portion of the strobel is narrower than the midfoot portion of the sole plate underlying the midfoot portion of the strobel.

2. The article of footwear of claim 1, further comprising:

a tensile member defining stitches extending through the footwear upper and the peripheral flange, the stitches securing the footwear upper to the peripheral flange.

3. The article of footwear of claim 1, wherein a rear extent of the strobel is secured to a foot-facing surface of the sole plate rearward of the forefoot portion of the sole plate and forward of the rear extent of the sole plate, wherein the rear extent is in the heel portion of the sole plate.

4. The article of footwear of claim 1, wherein the footwear upper wraps under the sole plate between a medial side of the sole plate and a lateral side of the sole plate and extends transversely outward of the polymeric bladder and the sole plate.

5. The article of footwear of claim 1, further comprising:

an outsole underlying the sole plate; wherein the footwear upper is sandwiched between the outsole and the sole plate.

6. The article of footwear of claim 5, wherein the outsole includes a forefoot outsole underlying the forefoot portion of the sole plate and a heel outsole underlying the heel portion of the sole plate and decoupled from the forefoot outsole.

7. The article of footwear of claim 6, wherein:

the forefoot portion of the sole plate includes a medial arm and a lateral arm spaced apart from the medial arm to define a central gap in the forefoot portion of the sole plate;

the polymeric bladder spans the central gap; and the forefoot outsole has a peripheral rim defining a forefoot aperture underlying the central gap of the sole plate.

8. The article of footwear of claim 7, wherein the forefoot outsole includes at least one transverse arm extending transversely inward from the peripheral rim into the forefoot aperture of the forefoot outsole and under the central gap of the sole plate.

9. The article of footwear of claim 8, wherein the at least one transverse arm includes a medial transverse arm extending transversely inward from a medial side of the forefoot outsole and terminating in the forefoot aperture, and a lateral transverse arm extending transversely inward from a lateral side of the forefoot outsole and terminating in the forefoot aperture, and the lateral transverse arm rearward of the medial transverse arm.

10. The article of footwear of claim 8, wherein the forefoot outsole includes a transverse bar spanning from a medial side of the peripheral rim of the forefoot outsole to a lateral side of the peripheral rim of the forefoot outsole rearward of the at least one transverse arm.

11. An article of footwear comprising:

a strobel including a polymeric bladder defining an interior cavity and configured to retain a fluid in the interior cavity, the polymeric bladder having a peripheral flange extending around a perimeter of the interior cavity from a medial side to a lateral side of the polymeric bladder at a front of the polymeric bladder;

a footwear upper secured to the peripheral flange; and a sole plate having a heel portion, a midfoot portion, and a forefoot portion;

wherein a rear extent of the strobel is secured to the sole plate or to the footwear upper forward of a rear extent of the sole plate;

wherein the forefoot portion of the sole plate includes a medial arm and a lateral arm spaced apart from the medial arm to define a central gap in the forefoot portion of the sole plate; and wherein the polymeric bladder spans the central gap.

12. The article of footwear of claim 11, wherein the sole plate includes at least one transverse arm extending transversely inward into the central gap of the sole plate.

13. The article of footwear of claim 12, wherein the at least one transverse arm includes a medial transverse arm extending transversely inward from a medial side of the sole plate and terminating in the central gap, and a lateral transverse arm extending transversely inward from a lateral side of the sole plate and terminating in the central gap, and the lateral transverse arm rearward of the medial transverse arm.

14. An article of footwear comprising:

a strobel including a polymeric bladder defining an interior cavity and configured to retain a fluid in the interior cavity, the polymeric bladder having a peripheral flange extending around a perimeter of the interior cavity from a medial side to a lateral side of the polymeric bladder at a front of the polymeric bladder;

a footwear upper secured to the peripheral flange;

a sole plate having a heel portion, a midfoot portion, and a forefoot portion; and an outsole underlying the sole plate;

wherein the footwear upper is sandwiched between the outsole and the sole plate;

wherein a rear extent of the strobel is secured to the sole plate or to the footwear upper forward of a rear extent of the sole plate;

wherein the outsole includes a forefoot outsole underlying the forefoot portion of the sole plate and a heel outsole underlying the heel portion of the sole plate and decoupled from the forefoot outsole; and wherein the heel outsole includes a central vertical through hole.

15. An article of footwear comprising:

a strobel including a polymeric bladder defining an interior cavity and configured to retain a fluid in the interior cavity, the polymeric bladder having a peripheral flange extending around a perimeter of the interior cavity from a medial side to a lateral side of the polymeric bladder at a front of the polymeric bladder;

a footwear upper secured to the peripheral flange; and a sole plate having a heel portion, a midfoot portion, and a forefoot portion;

wherein a rear extent of the strobel is secured to the sole plate or to the footwear upper forward of a rear extent of the sole plate; and wherein the sole plate includes a plurality of upwardly-extending support ribs arranged in a web pattern and defining a plurality of recesses between the support ribs.

* * * * *